US010781633B2

(12) United States Patent
Riemelmoser et al.

(10) Patent No.: US 10,781,633 B2
(45) Date of Patent: Sep. 22, 2020

(54) RETROFITABLE RETRACTABLE SCREEN SYSTEM

(71) Applicant: SCREENAWAY USA PTY LTD, Adelaide (AU)

(72) Inventors: Concetta Antonina Riemelmoser, Salisbury Heights (AU); John Riemelmoser, Salisbury Heights (AU); Kenneth Robert Doley, Salisbury Heights (AU); Mark Leslie Schmick, Salisbury Heights (AU)

(73) Assignee: SCREENAWAY USA PTY LTD, Adelaide (AU)

( * ) Notice: Subject to any disclaimer, the term of this patent is extended or adjusted under 35 U.S.C. 154(b) by 200 days.

(21) Appl. No.: 15/328,610

(22) PCT Filed: Jul. 27, 2015

(86) PCT No.: PCT/AU2015/000436
§ 371 (c)(1),
(2) Date: Jan. 24, 2017

(87) PCT Pub. No.: WO2016/015084
PCT Pub. Date: Feb. 4, 2016

(65) Prior Publication Data

US 2017/0211325 A1 Jul. 27, 2017

(30) Foreign Application Priority Data

Jul. 28, 2014 (AU) ..... 2014902919

(51) Int. Cl.
*E06B 9/58* (2006.01)
*E06B 9/54* (2006.01)
(Continued)

(52) U.S. Cl.
CPC ..... *E06B 9/54* (2013.01); *E06B 9/08* (2013.01); *E06B 9/40* (2013.01); *E06B 9/56* (2013.01);
(Continued)

(58) Field of Classification Search
CPC ... E06B 9/581; E06B 9/08; E06B 9/17; E06B 9/42; E06B 9/54; E06B 9/62; E06B 9/56; E06B 9/40; E06B 2009/527
(Continued)

(56) References Cited

U.S. PATENT DOCUMENTS 740,033 A 9/1903 McNamara
1,335,573 A * 3/1920 Forcoz ..... E06B 9/54 160/27
(Continued)

FOREIGN PATENT DOCUMENTS

CN 2054478 U 3/1990
CN 101021141 A 8/2007
(Continued)

*Primary Examiner* — Katherine W Mitchell
*Assistant Examiner* — Jeremy C Ramsey
(74) *Attorney, Agent, or Firm* — Erickson Kernell IP, LLC; Kent R. Erickson

(57) ABSTRACT

A retrofitable retractable screen system for use with windows or doors. Instead of using a spring based tensioning arrangements to rewind the screen onto the roller assembly, the arrangement uses a pulley located on the spindle, around which is wrapped a cord. A guide assembly guides the cord around a tension adjustment arrangement that adjusts the tension in the cord as the screen is wound and unwound from the spindle to provide a smooth mechanism to extend and retract the screen. When the screen is extended, pushing the edge of the screen to force retraction of the screen is translated into a pulling action on the cord to unwind the cord off a pulley, which drives rotation of the spindle to wind the screen back on. Conversely, pulling the distal edge to
(Continued)

extend the screen rotates the spindle and pulley to wind the cord back onto the pulley.

11 Claims, 15 Drawing Sheets

(51) Int. Cl.
*E06B 9/62* (2006.01)
*E06B 9/08* (2006.01)
*E06B 9/40* (2006.01)
*E06B 9/56* (2006.01)
*E06B 9/52* (2006.01)

(52) U.S. Cl.
CPC ..... *E06B 9/581* (2013.01); *E06B 9/62* (2013.01); *E06B 2009/527* (2013.01)

(58) Field of Classification Search
USPC ..... 160/314
See application file for complete search history.

(56) References Cited

U.S. PATENT DOCUMENTS

| | | | | |
|---|---|---|---|---|
| 1,780,461 | A * | 11/1930 | Byars | E06B 9/54 160/265 |
| 1,893,651 | A | 1/1933 | Ray | |
| 4,762,160 | A | 8/1988 | Bechtold et al. | |
| 4,896,714 | A * | 1/1990 | Ellis | E06B 9/08 160/264 |
| 5,456,303 | A | 10/1995 | Horinouchi | |
| 5,533,559 | A | 7/1996 | Judkins | |
| 5,915,443 | A | 6/1999 | Lindley, Jr. | |
| 6,167,936 | B1 | 1/2001 | Stover et al. | |
| 6,478,070 | B2 | 11/2002 | Poppema | |
| 6,591,890 | B1 | 7/2003 | Grubb et al. | |
| 8,011,413 | B2 | 9/2011 | Poppema | |
| 8,056,601 | B2 | 11/2011 | Kirby et al. | |
| 8,113,264 | B2 | 2/2012 | Kirby et al. | |
| 2001/0042346 | A1 | 11/2001 | Brioschi | |
| 2004/0154753 | A1 | 8/2004 | Tagtow et al. | |
| 2008/0163988 | A1 | 7/2008 | Hicks et al. | |

FOREIGN PATENT DOCUMENTS

| | | | |
|---|---|---|---|
| DE | 4036892 | A1 | 5/1992 |
| FR | 2686372 | A1 | 7/1993 |
| GB | 433498 | A | 8/1935 |
| GB | 1188690 | A | 4/1970 |
| GB | 2166480 | A | 5/1986 |
| JP | 2001234678 | A | 8/2001 |
| TW | 201122208 | A | 7/2011 |

* cited by examiner

RETROFITABLE RETRACTABLE SCREEN SYSTEM

PRIORITY DOCUMENTS

The present application claims priority from Australian Provisional Patent Application No. 2014902919 titled "A RETROFITABLE RETRACTABLE SCREEN SYSTEM" and filed on 28 Jul. 2014, the content of which is hereby incorporated by reference in its entirety.

TECHNICAL FIELD

The present disclosure relates to a retractable screen system that can be retrofitted to windows and doors to screen the door or window when in an open position.

BACKGROUND

It is a common requirement to provide a screen in relation to doors or windows. For example, in the case of a window, there may be provided a horizontal or vertical sliding window panel which is used to open the window or a hinged window panel with a hinge in the upper edge and that is opened by using a winding mechanism to pivot the lower part of the window panel about the upper hinge, or a similarly hanging panel hinged on the vertical edge. Conventionally, a screen is used to prevent ingress of insects or debris while at the same time providing ventilation. Also, screens are generally open mesh which also provides visibility through the screen.

One disadvantage in the case of windows is that existing screen systems cover one half or a number of portions of the window. They are generally permanently installed screens so that a portion of the window provides a clear view while for the remainder of the window, the user will have to look through the window and screen. In some cases the screen covers the entire window panel (for example in the case of a hinged window panel) so that the user will have to look through the window and screen. It would be much more desirable to have simply glass unobstructed by any screens.

Also, the screens are normally provided in a frame which is then mounted to the window. This then results in restricted access to the window for the purpose of cleaning or other maintenance.

Sliding doors are common, but in these cases it is necessary to have both a sliding door with glass and a second sliding door with the screen. In certain circumstances it would be desirable to eliminate the need for a second door.

There is thus a need to provide a screen system that can be retrofitted to a window or door opening that eliminates some of these disadvantages, or at least provides a useful alternative to existing systems.

SUMMARY

According to a first aspect, there is provided a retrofitable retractable screen system for insertion into a frame of a window or door opening to allow the window or door opening to be covered when in an open position, the system comprising:

a screen support assembly defining a screen opening and adapted for insertion into and removal from window or door frame;

a roller assembly comprising:

a screen;

a spindle rotatably mounted adjacent the screen opening around which the screen is wound so that the screen can be unwound from or wound onto the spindle; and a spindle rotation assembly for rotating the spindle;

at least one operative means connected between the screen and the spindle rotation assembly that causes the spindle to rotate so as to wind the screen back onto the spindle as the screen is retracted across the screen opening; and at least one guide assembly for guiding the operative means, wherein the guide assembly guides the operative means through or around a tension adjustment arrangement that adjusts the tension in the operative means as the screen is wound and unwound from the spindle.

In one form, the guide assembly guides the operative member from the spindle to a first guide component that directs the operative means to the tension adjustment arrangement, and the tension adjustment arrangement directs the operative means to a second guide component which directs the operative means to a distal edge of the screen with respect to the spindle.

In a further form, the screen support assembly comprises at least one channel for guiding a portion of the distal edge of the screen as it is unwound from and wound onto the spindle, and the second guide component directs the operative means to extend along and within the at least one channel where it is anchored to the portion of the distal edge of the screen located in the at least one channel.

In a further form, the tension adjustment arrangement is located proximal, with respect to the spindle, of both the first guide component and the second guide component, to direct the operative means through a double back path via the tension adjustment arrangement.

In a further form, the first guide component and the second guide component are pulleys each with an axis parallel to the spindle axis, and the tension adjustment arrangement comprises a spring anchored to the screen support assembly at a proximal end, and to a pulley housing at the distal end, and the distal end of the pulley housing houses a pulley with an axis orthogonal to the spindle axis.

In a further form, the spindle rotation assembly comprises a spindle pulley and the at least one operative means is a cord that wraps around the spindle pulley, such that as the screen is wound onto the spindle as the screen is retracted across the screen opening, the cord is wound off the spindle pulley.

In one form, the screen support assembly is a frame arrangement comprising a spindle frame member, a first side frame member, a second side frame member, and a distal frame member, wherein the at least one guide assembly is housed in one or both of the first side frame member and the second side frame member.

In a further form, the at least one operative means comprises two operative means, and the at least one guide assembly comprises two guide assemblies and each of the first side frame member and the second side frame member house an operative means and a guide assembly.

In a further form, the one or both first side frame member and the second side member that house the at least one guide assembly comprise a removable cover for providing access to the at least one guide assembly.

In one form, the retrofitable retractable screen system wherein the system is adapted for insertion into and removal from a window or door frame by the screen support assembly comprising a plurality of outwardly biased sprung tabs.

In one form, the screen comprises a distal edge, the distal edge comprising a handle to allow independent extension and retraction of the screen independent of movement of the window panel. In an alternative form, the screen comprises a distal edge, the distal edge comprising a window panel attachment means, for attachment to a handle of the window panel such that movement of the window panel to open and close the window causes extension and retraction of the screen across the window opening.

BRIEF DESCRIPTION OF DRAWINGS

Embodiments of the present disclosure will be discussed with reference to the accompanying drawings wherein.

In the following description, like reference characters designate like or corresponding parts throughout the figures.

DESCRIPTION OF EMBODIMENTS

Various embodiments of a retractable screen system for retrofitting or installation by insertion into a frame of a window or door opening, or similar cavity, to allow the window or door opening to be covered when in an open position will now be described.

Figure 1A:
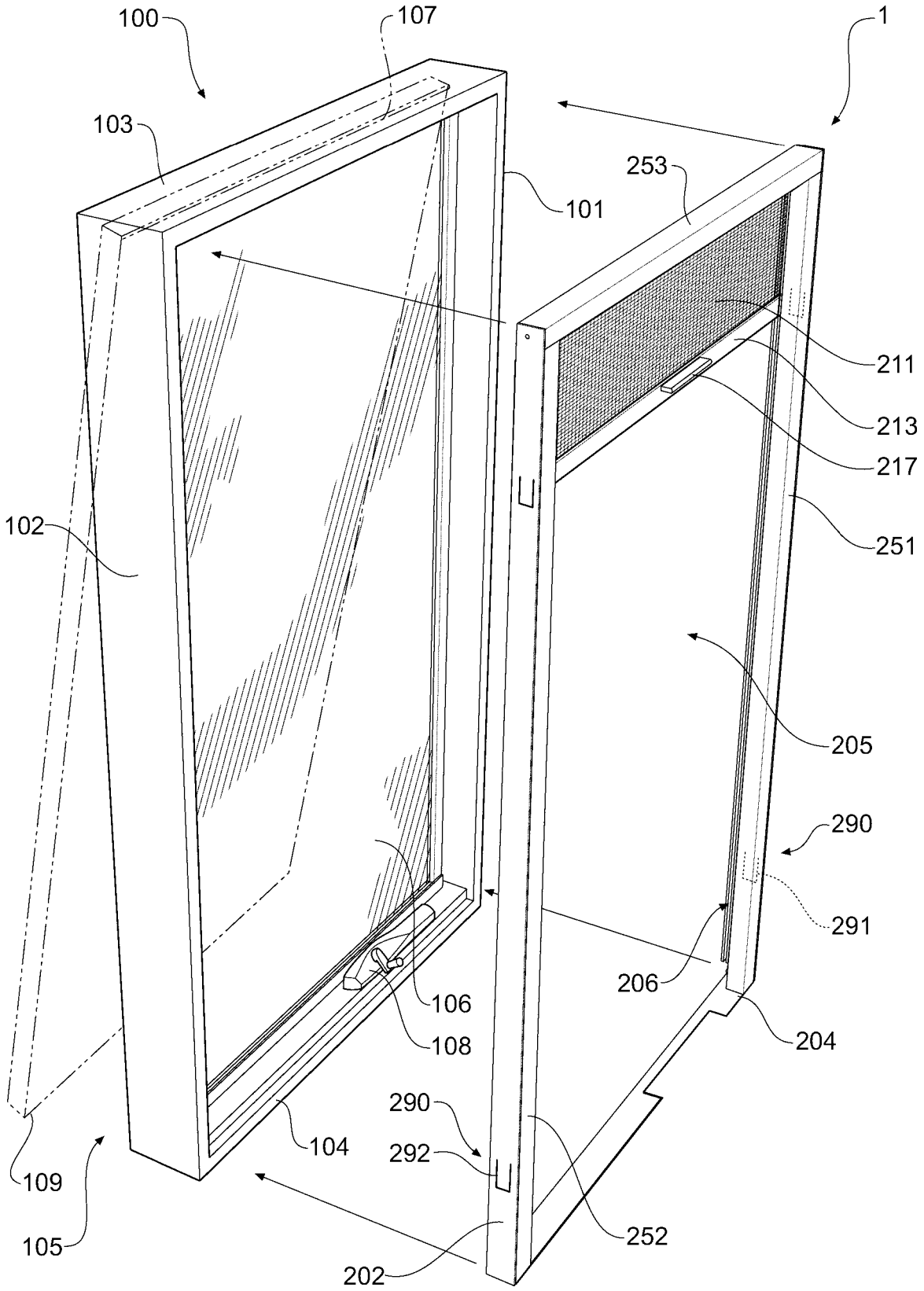
FIG. 1A illustrates a window frame with a hinged window and a retrofitable screen system according to an embodiment.
Figure 1B:
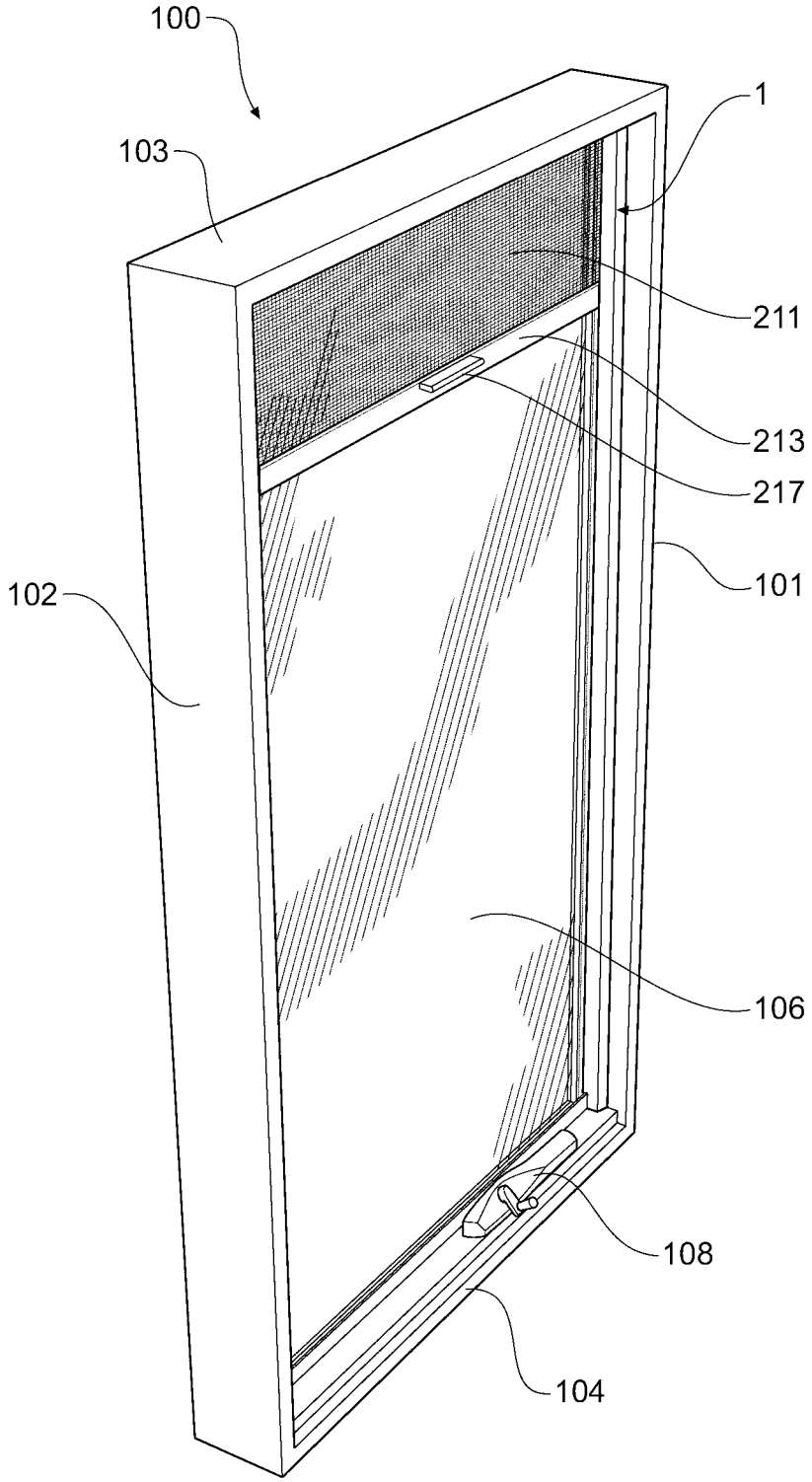
FIG. 1B illustrates the window frame of FIG. 1A fitted with the retrofitable screen system according to an embodiment.
Figure 1C:
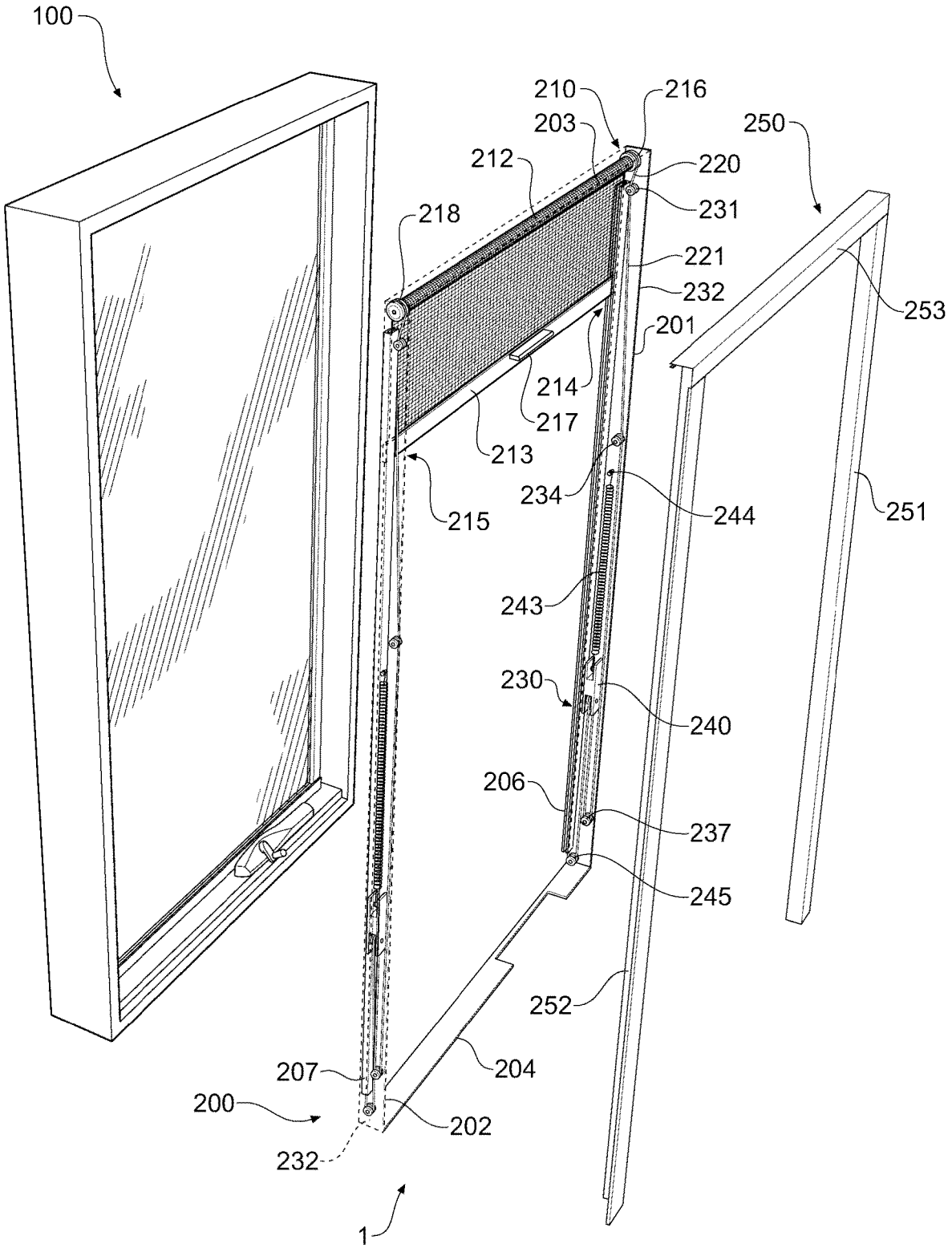
FIG. 1C illustrates an exploded view of the retrofitable screen system of FIG. 1A with reference to the window frame according to an embodiment.

Referring now to FIG. 1A, there is shown a window frame 100 for a hinged window panel 106 about to be fitted with a retrofitable retractable screen system 1 according to an embodiment of the disclosure. FIG. 1B illustrates the window frame of FIG. 1A fitted with the retrofitable retractable screen system 1. FIG. 1C illustrates an exploded view of the retrofitable retractable screen system of FIG. 1A further illustrating the method of installation comprising installing the screen support assembly 200, to which a roller assembly 210, operative means 220 and guide assembly 230 are mounted, followed by covers 250 to cover and protect the system components. The window frame 100 comprises a pair of side members 101 and 102 and a spindle frame member 103 and a distal frame member 104. These frame members 101, 102, 103 and 104 provide a rectangular frame which can be mounted within a building such as a house. A window panel 106 is attached to a hinge 107 located on the spindle frame member 103, and is opened and closed using a winding mechanism 108 to pivot the lower part of the window panel 106 about the spindle hinge 107 to define a window opening 105. The position of the open window 109 is indicated by the dashed lines in FIG. 1A.

As can be seen in FIGS. 1A and 1C, a screen support assembly 200 is inserted into the window frame 100. In this embodiment, the screen support assembly is a screen frame comprising a pair of screen side members 201 and 202, and a screen spindle frame member 203 and a screen distal frame member 204 which when assembled define a screen opening 205. In the following description the terms proximal and distal are defined with respect to the spindle axis. The screen support assembly 200 houses or provides a mount for a roller assembly 210 that comprises a screen 211 wound around a rotatably mounted spindle 212. The spindle 212 is mounted so that the spindle axis is parallel with the spindle frame member so that it is adjacent to the screen opening. In this embodiment the spindle 212 is mounted to the two screen side members 201 202 and the spindle 212 acts as a beam component together with the spindle frame member 203 to space apart the two screen side members. However, in other embodiment the screen spindle frame member 203 may provide this bracing structure, to space apart the two screen side members 201 202. In some embodiments, the spindle 212 is mounted to a side of the spindle frame member, for example using L shaped mounts.

The screen 211 may comprise a mesh material, such as plastic or wire mesh material with apertures sized to allow air flow whilst preventing the entry of insects or other matter such as leaves/litter (eg a fly screen mesh). Alternatively, the screen could be a semi-opaque or opaque material or block-out material to provide privacy or to reduce the amount of light passing through the screen opening, ie for use as a window blind. The screen has a distal edge (that could be referred to as a leading edge or first edge) 213 that can be pulled away from the spindle (ie in this context down) to unwind the screen from the spindle and extend the screen across the screen opening 205. When the screen opening is no longer required to be covered (eg when the window is closed, or additional light is desirable), the screen is retracted by pushing the distal edge 213 back towards the spindle (ie in this context up). This acts to rotate the spindle through an operative means 220 threaded through a guide assembly 230 located in the screen side member 201 to wind the screen back onto the spindle in order to uncover the screen opening. The operative means may be a single cord or cable, or a more complicated multi-component linkage arrangement comprising linked flexible and rigid members (eg with the flexible members passing around pulleys and rigid members spanning the gap between pulleys).

The guide assembly 230 functions to facilitate easy opening and closing of the screen without significant or discernible inertia when moving the screen. To assist in the opening and closing operation, the side members 201 and 202 comprise screen guide channels 206 207 to guide a portion of the distal edge, such as the ends of distal edge and trailing screen mesh as the screen extends and retracts over the screen opening 205. That is the distal edge 213 has two ends 214 215 corresponding to the bottom corners of the screen which are housed within the respective first and second screen guide channels. To facilitate guiding of the screen the ends or channels may be moulded or fitted with a slideable insert or one or more rollers or bearings that run along the channel. When fully extended the screen 211 covers the screen opening 205.

In this embodiment, the operative means 220 is a cord or cable 221 mounted on an anchor point 222 located at one end of the distal edge of the screen. The anchor point is located within the first guide channel 206 of the first side member 201 so that the cord extends along and within the channel and is directed by the guide assembly 230 to a first pulley 216, also referred to as the spindle pulley, located on the first side of the spindle 212 forming part of the roller assembly 210. The end of the cord 221 is secured to and coils (or wraps) around the first pulley 216. As the screen is pulled by the distal edge 213 to extend the screen 211 across the screen opening 205 and off the spindle, the pulley 216 is forced to rotate and wind the cord 221 onto the first pulley 216. Then, as the screen is retracted the cord 221 is wound off the pulley to cause the spindle to rotate so as to wind the screen back onto the spindle. As the screen winds off the spindle the cord winds back onto the pulley, and as the screen winds back onto the spindle, the cord winds off the pulley. The pulley has a fixed diameter, and as the cord is wound on, it winds around itself to increase the effective diameter of the cord wrapped around the spindle pulley 216.

The change in diameter of the cord 221 around the spindle pulley 216 can change the tension in the cord as the screen is retracted and extended across the screen opening. To compensate for any changes in tension associated with the change in diameter or change in length of the loop, the guide assembly 230 guides the operative means 220 through or around a tension adjustment arrangement that adjusts the tension in the operative means 220 as the screen is wound and unwound from the spindle. In some embodiments, the guide assembly guides the operative member from the spindle to a first guide component that directs the operative means to the tension adjustment arrangement, and the tension adjustment arrangement directs the operative means to a second guide component which directs the operative means to a distal edge of the screen with respect to the spindle. In this embodiment, the tension adjustment arrangement is located proximal, with respect to the spindle, of both the first guide component and the second guide component, to direct the operative means through a double back path via the tension adjustment arrangement.

Figure 2A:
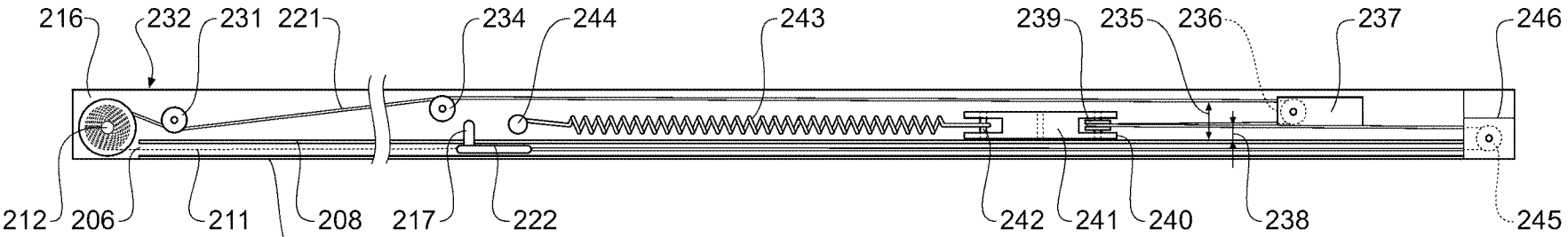
FIG. 2A is a first side view looking into the first side member from the side edge of the window frame showing the roller assembly, operative means and guide assembly according to an embodiment.
Figure 2B:
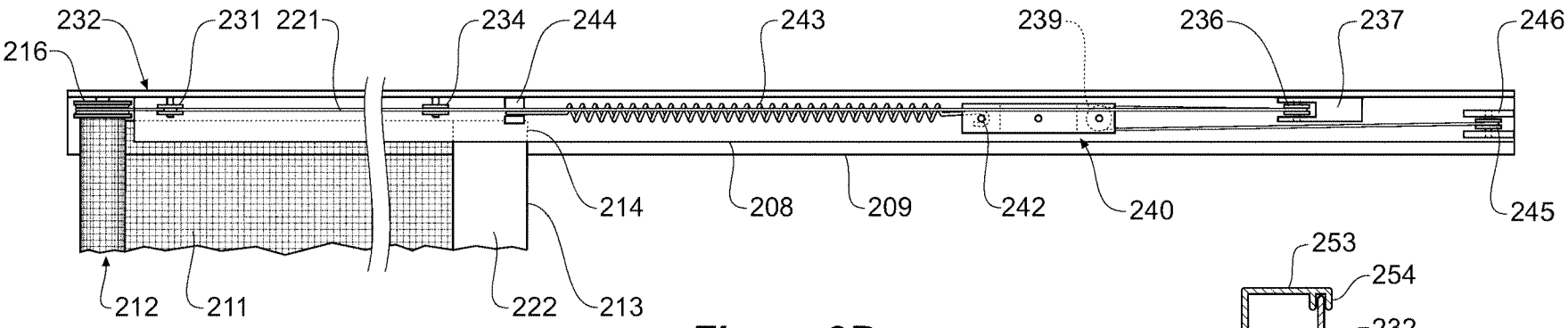
FIG. 2B is a front view of the first side member showing the roller assembly, operative means and guide assembly according to an embodiment.
Figure 2C:
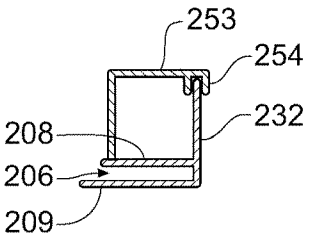
FIG. 2C is an end view of the first side member according to an embodiment.

As shown in FIGS. 2A to 2C, the first side member 201 houses the first guide channel 206 and the guide assembly 230 for the cord 221. In use the first side member 201 is covered by a cover 251 (see FIG. 2C). FIG. 2A is a first side view looking into the first side member from the side edge of the window frame and FIG. 2B is a front view of the first side member showing the roller assembly 210, operative means 220 and guide assembly 230 according to an embodiment. FIG. 2C shows an end view of the side member according to an embodiment showing the profile of the side member 201 and cover 253. An equivalent arrangement is located within the second side member 202 to further assist in providing a smooth movement of the screen. However, in other embodiments a single operative member and single guide assembly is located in one of the two side members.

The first side member 201 has an L shaped profile and comprises a first guide channel 206 defined by inner wall 208 and rear wall 209 orthogonally project up from the outer wall 232. The outer wall 232 is orientated as a column abutting (or parallel to) the first side member 101 of the window frame member. The external side of the cover 251 is visible and thus may be decorated or finished to provide a desired aesthetic appearance. In this embodiment the cover 251 is removable to allow access to the internal components of the guide assembly so that they can be adjusted during installation or maintenance to ensure smooth operation of the system. Removability of the cover may be provided by slot 254 in cover 251 that receives outer wall 232 with a snug fit, or alternatively providing projections on the inner side of the cover 251 designed to clip into receiving members in the outer wall 232 and inner wall 208, although other attachment arrangements could be used such as removable fasteners, magnets etc. A similar arrangement may be provided on the second side frame member cover 252 and the screen spindle frame member cover 253 to allow attachment to the second side frame member 202 and the screen spindle frame member 203 respectively.

In the embodiment, the first guide component and the second guide component are pulleys each with an axis parallel to the spindle axis, and the tension adjustment arrangement comprises a spring anchored to the screen support assembly at a proximal end, and to a pulley housing at the distal end, and the distal end of the pulley housing houses a pulley with an axis orthogonal to the spindle axis.

As can be seen in the Figures, the guide assembly guides the cord (or other operative member) 221 from the first pulley 216 acting as a capstan for the spindle and located at one end of the side member (near the spindle frame member 203), through a double back path via a tension adjustment arrangement 240. The cord is directed around a second pulley 236 fixedly mounted with respect to the first side member, and a third pulley 239 mounted within the tension adjustment arrangement 240. After passing around the third pulley 239 the cord passes around a fourth pulley 245 located at the other end of the first screen side member 201 (near the distal frame member 204) and directs the cord back along the first guide channel 206 to the anchor point 222 on the first end 214 of the distal edge 213.

As can be seen in FIG. 2A, as the cord 221 leaves the first pulley 216 it passes around a first proximal guide projection 231, projecting out from the outer wall 232 and located proximal to the junction of outer wall 232 and the inner wall 208. The guide projection may be a guide pin with a smooth shaft projecting out from the outer wall 232, or a pulley mounted on a shaft (eg a screw) secured to the outer wall 232. A second guide projection 234 projecting from the outer wall 232 is located distal of the first pulley 216 (along the outer wall), and distal of the junction of outer wall 232 and the inner wall 208. Hence, when looking at the outer wall the cord will follow a low to high inclined path from the first guide projection 231 to the second guide projection 234. After the second guide projection 234 the cord runs substantially at a first height 235 (ie parallel with the junction of outer wall 232 and the inner wall 208) until it enters the second pulley 236. The second pulley 236 is mounted within a mounting arrangement 237 fixed or secured to the outer wall 232, such as by screws or other fasteners. The axis of the second pulley 236 projects out from the outer wall 232 so that is parallel with the axis of the first pulley 216 and spindle axis, and redirects the cable back towards the first pulley at a second height 238, lower than the first height 235 (with respect to the inner wall 208). The cord 221 then runs substantially at the second height to the third pulley 239.

The third pulley 239 is mounted within a tension adjustment arrangement 240 with an axis orthogonal to the spindle axis and inner wall 208. The tension adjustment arrangement comprises a pulley housing 241 that houses the third pulley 239 at the distal end, and a first spring anchor 242 at the proximal end, to which the distal end of a spring 243 is fixed. The proximal end of the spring 243 is fixed to a second spring anchor 243 (proximal to the first pulley 216 and spindle 212 compared to the pulley housing 241). The tension adjustment 240 provides a component that can adjust for a change in the tension in the cord 240 as the cord is wound or unwound from the first pulley 216. The mount housing rests on the inner wall 208 and outer wall 232 and is not secured within the cavity 208. Instead, it is secured at the proximal end by the spring 243 and at the distal end by the cord around the third pulley and thus can move laterally between the spindle frame and distal frame within the first cavity. As the cord is wound or unwound from the first pulley 216, the tension in the cord will change due to the change in length associated with movement of anchor point 222. The spring force from spring 243 acts to adjust or compensate for this change in tension force, and allows for movement of the mount housing 241. Further as can be seen in FIG. 2A, the second guide projection is located, both distal of the spindle and at a height above the inner wall 208 (ie at the first height 235), to provide sufficient clearance from the mount housing 241 for the section of the cord 221 running from the first pulley 216 to the fixed second pulley 236. Further, during installation or construction, the location of the second pulley can be selected to set the initial balance between spring force and cord tension to minimise any inertial or resistance forces during use.

After exiting the third pulley 239, the cord 221 is still at the second height with respect to the inner wall 208. As shown in FIG. 2B, the cord wraps around the third pulley to space the cord away from the outer wall so that it can pass in front (or over the top) of the second pulley mounting arrangement 237 and onto the fourth pulley 246. The fourth pulley is mounted in a mounting arrangement 246 so that the pulley axis is parallel to the spindle axis and the axis of the first and second pulleys, and orthogonal to the outer wall. One edge of the fourth pulley is at the second height 238 in order to guide the cord 221 into the first screen guide channel 206 (by passing around the fourth pulley 245) where it is anchored to anchor point 222 of the distal edge.

Figure 3A:
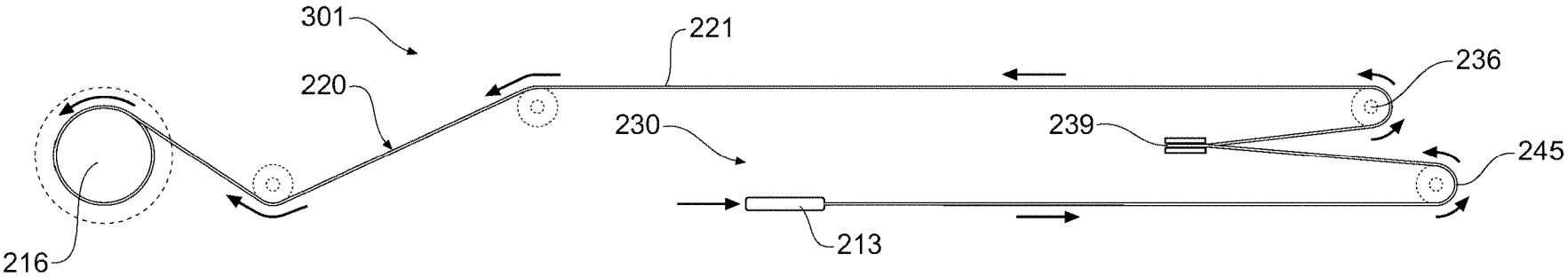
FIG. 3A is a side view illustrating relative movements of an operative member comprising a cord and components of the guide assembly when the screen is extended across an opening according to an embodiment.
Figure 3B:
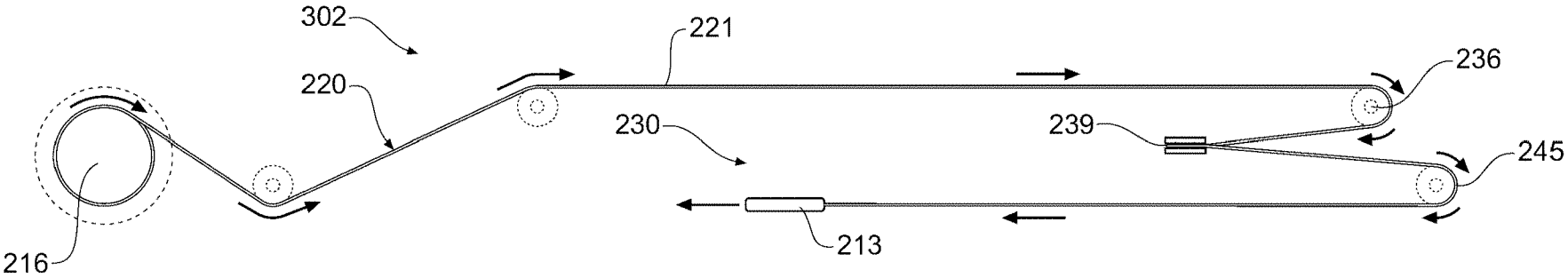
FIG. 3B is a side view illustrating relative movements of an operative member comprising a cord and components of the guide assembly when the screen is retracted across an opening according to an embodiment.

FIG. 3A is a side view 301 illustrating relative movements of an operative member comprising a cord and components of the guide assembly when the screen is extended across an opening according to an embodiment. Similarly, FIG. 3B is a side view 302 illustrating relative movements of an operative member comprising a cord and components of the guide assembly when the screen is retracted across an opening according to an embodiment. The use of the double back path and a tension adjustment arrangement coupled with the use of a guide channel and anchoring of the cord (or other operative means) 221 to the anchor point 222 provides a smooth mechanism in which the pushing the distal edge to retract the screen pulls the cord 221 to unwind the cord off the first pulley 216 and thus drives the (clockwise in FIG. 2A) rotation of the spindle to wind the screen back on. Conversely, pulling the distal edge to extend the screen rotates the spindle and pulley to wind the cord back onto the first pulley 216. The use of a double back path and a tension adjustment arrangement also allows the mechanism to have a low thickness or profile, so that the support assembly does not extend in from the window frame and unnecessarily obscure the window panel.

Figure 3C:
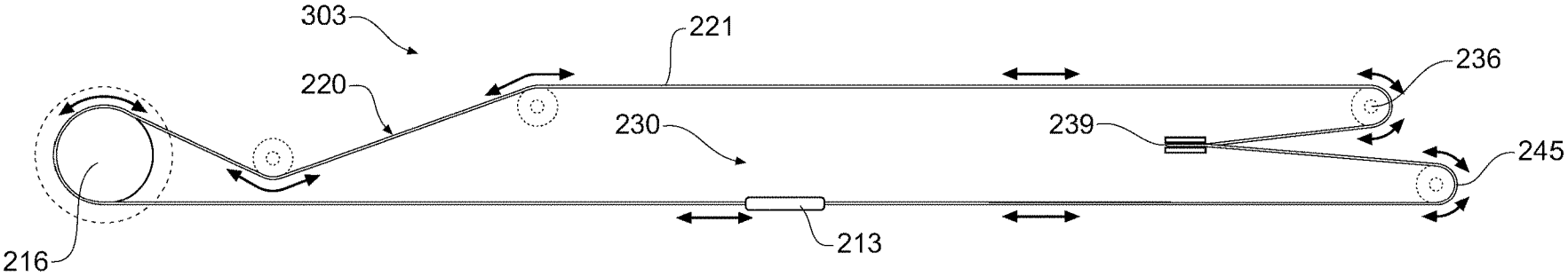
FIG. 3C is a side view illustrating relative movements of an operative member comprising a loop and components of the guide assembly when the screen is extended or retracted across an opening according to an embodiment.

In another embodiment, the operative means 220 is a belt or a loop 223. In this case the operative means does not fully wrap around and wind/unwind onto the pulley 216 but instead passes around an arc of the pulley sufficient to drive rotation of the pulley. FIG. 3C is a side view 303 illustrating relative movements of an operative member comprising a loop and components of the guide assembly when the screen is extended or retracted across an opening according to an embodiment. The loop may be a cable or ribbon anchored to both sides of the distal edge 213. In this embodiment, the loop spans an arc of the first pulley (rather than being wound onto or off the first pulley) and frictional engagement between the cord and the first pulley forces rotation of the spindle (and conversely rotation of the spindle causes movement of the cord). This arrangement requires a good grip between the cord 213 and the pulleys in order to avoid any slippage. This can be achieved during installation by adjusting the location of the tension adjustment arrangement 240 during installation to select an appropriate tension for smooth operation of the system. In other embodiments, the pulleys could each be sprockets and the loop could be a chain loop or toothed belt (ie comprising regularly spaced projections) to engage with the sprocket teeth. Such an arrangement will avoid any possible slippage.

To improve the smoothness of the opening and closing action this embodiment comprises a tension adjustment arrangement 240. The tension adjustment 240 provides a component that can adjust for a change in the tension in the cord 221 as the cord is wound or unwound from the first pulley 216. In the embodiment shown in FIG. 2A, the second spring anchor 244 is fixed. However, in other embodiments the location of the second spring anchor could be adjustable or determined during installation, based upon the location that provides the smoothest operation. For example, in one embodiment, a series of apertures or channels could be provided in and along the outer wall at the time of manufacture and during installation the installer could select which of the apertures or positions along the channels to install the second spring anchor into. This could be based on trials performed on the installed system. Additionally, such an approach would enable further adjustment/maintenance once the system is in use to compensate for any ageing or variation in the cord or screen tension over time. Alternatively, no apertures need to be provided in the outer wall, and the installer could simply test possible locations, and then install the second spring anchor in a selected location at the time of installation. This approach allows an installer to compensate for any manufacturing variations, or other variations associated with the specific window the system is being retrofitted to. In other embodiments, the tension adjustment arrangement 240 is replaced with a fixed pulley. In such cases the location of the fixed pulley could be determined during manufacture or installation by performing test operations in order to determine the location that provides smoothest operation.

The screen frame 200 is adapted for insertion and removal from the window frame 100. This may be achieved in several ways. In one embodiment, the dimensions of the window frame are accurately measured and the screen frame is constructed to closely match these. This allows for slideable insertion and removal of the screen frame 200 into and out of the window frame 100, with the close match of window frame to screen dimensions passively retaining the screen frame in place. In other embodiments, the screen may be adapted for insertion and removal using a mounting arrangement 290 that can be positively engaged to retain the screen frame in place, and disengaged when it is desirable to remove the screen frame. The use of a mounting arrangement provides greater flexibility, as it allows for greater tolerances during manufacture of the frame and compensation for variations between the actual dimensions of the window frame and the screen frame that can occur for a variety of reasons such as measurement errors, imperfect construction, deviation from orthogonality, temperature effects, or humidity effects. It may also allow use of the system with standard or nominal window frame sizes, or a range of sizes (ie allowing consumers to measure their windows and select the appropriate screen frame to match).

The mounting arrangement 290 comprises one or more mounts or components to firmly mount or fix the screen frame 200 in the window frame 100. In this embodiment, the mounting arrangement is a clipable arrangement comprising a plurality of clips. As shown in FIG. 1, the screen side frame members 201 and 202 each comprise an outwardly sprung tab, 291 and 292, to positively engage with the window frame and thus to lock the screen frame in place though frictional forces. Removal can be performed by using a screw driver or similar tool to depress one of the tabs. In other embodiments the locations of the tabs could be varied, for example one screen side member 201 and the spindle or distal screen frame members 203 or 204. Similarly, other arrangements could be used, for example a set of screwable fasteners such as blunt screws that are accessible from the screen opening, and pass through a threaded portion of the screen frame members to allow screwable engagement (or disengagement) with the window frame members. In some embodiments, the fasteners may be hidden behind a removable cover. In one embodiment, double sided adhesive strips or tape is applied to the portions of the support frame assembly (eg members 201, 202, 203 and 204) to bond or secure the support frame assembly to the window frame (or vice versa). In another embodiment, the exterior of the slot 254 of the covers could be used as the mounting arrangement. In this embodiment, the outermost arm of the slot 254 engages with both the window frame and the respective support frame assembly member. The profile of the outermost arm of the slot could be tapered or formed with a sprung tabs to positively engage with the window frame and thus to lock the screen frame in place though frictional forces.

The screen support assembly members 200 will typically be comprised of several components which are assembled to form a housing or external cover for internal components of the system. When installed the support assembly members act or provide a rigid structure for mounting of the components of the screen system. The components of the assembly members may be thin sheets or extrusions manufactured from suitable materials such as aluminium alloys, steel alloys, and plastics. In the previous embodiment the members form a frame around the screen opening and houses the operative means and guide assembly. In another embodiment, the members need not form a complete frame or house all guide assembly components. For example, the member opposite the spindle (ie distal frame member 204) only acts to separate the distal (with respect to the spindle) ends of the side members, and thus could be omitted. In such an embodiment, the remaining members need to be constructed or designed to have sufficient rigidity when installed to ensure normal operation of the system. This could be achieve by using a mounting arrangement located at the proximal end of each side member so that when installed in the window frame, the mount comprise a member that extends to lock the side members between the upper and lower window frame members. Other variations, modifications and additions are also possible. For example, in one embodiment the channels 206 and 207 are provided with brush or felt strips to form an air resistant seal at the edges of the screen 211. In other embodiments, the pulleys could be replaced with semi-circular channels manufactured of low friction materials so that the cord can smoothly run through channel.

Figure 4A:
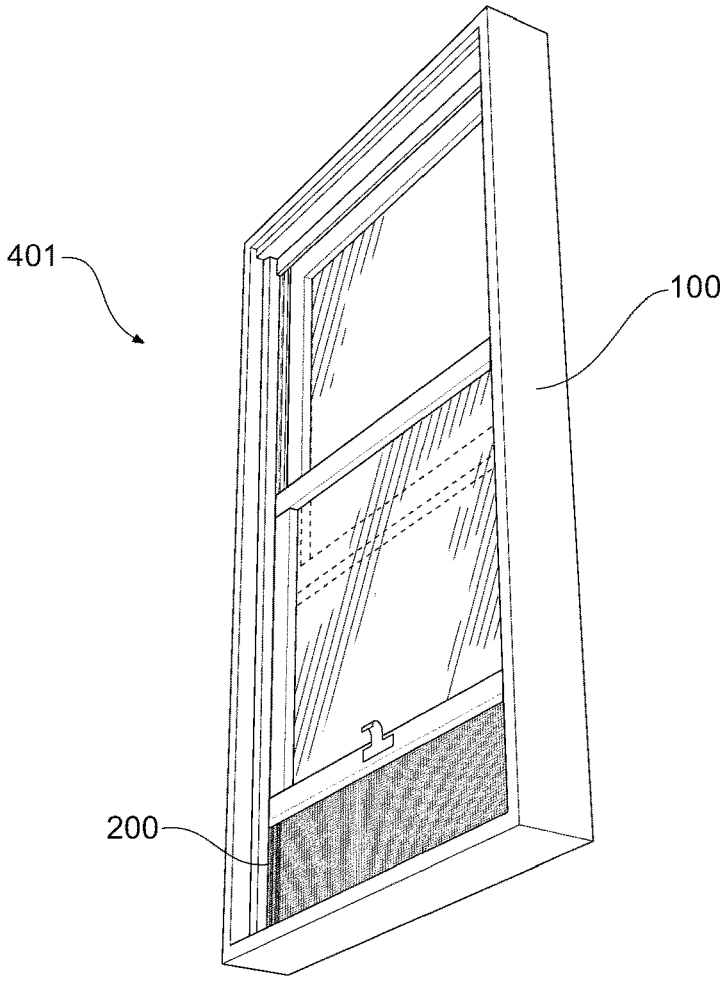
FIG. 4A illustrates a window frame with a vertically sliding window fitted with a retrofitable screen system according to an embodiment.
Figure 4B:
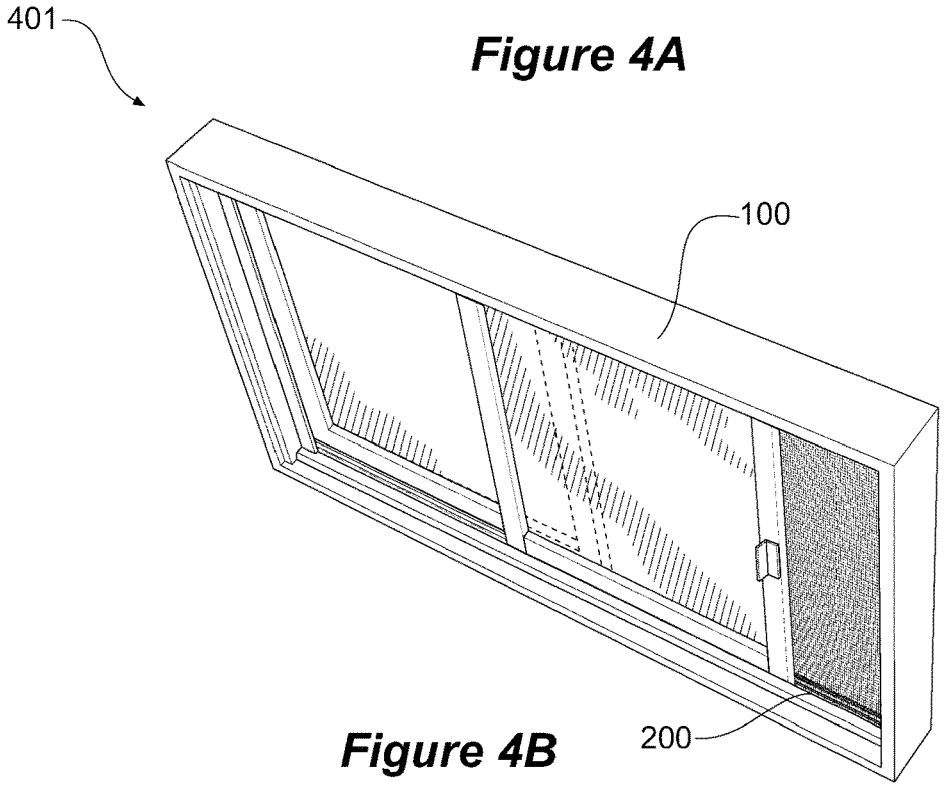
FIG. 4B illustrates a window frame with a horizontally sliding window fitted with a retrofitable screen system according to an embodiment.

In the embodiment shown in FIGS. 1A to 1C, the window frame houses a hinged window panel 106. However, it will be realised that the system will be suited to other applications such as sliding windows, hinged doors, or sliding doors, whether horizontally or vertically hinged or sliding, or in fact any situation where an opening is required to be covered by a screen. The system can be used for both small and large windows. Depending upon the size of the window and components chosen, there may be a one or two sets of operative means and guide assemblies located in the side members. For example, FIG. 4A illustrates a window frame with a vertically sliding window (ie a sash window) 401 fitted with a retrofitable retractable screen system according to an embodiment, and FIG. 4B illustrates a window frame with a horizontally sliding window 402 fitted with a retrofitable retractable screen system according to an embodiment. In these embodiments, the distal edge 213 may be attached to the edge of the sliding portion of the window so that movement of the window also drives movement of the screen across the opening. In one embodiment, the distal edge comprises an attachment arrangement in place of the handle 217 shown in FIG. 1A. In one embodiment, the attachment arrangement is an elastic cord or strap that is looped over an existing window handle. In another embodiment, the attachment arrangement is a pair of apertures in the distal edge and a pair of screws which are screwed through the aperture and into the window frame. Alternatively, the distal edge may be independent of the window, so that when a window is opened, a user can choose whether or not to cover the opening with the screen or not. For example, they could elect to leave the screen retracted during the day, so the window opening is unobstructed, and then extend the screen across the opening in the afternoon or evening to prevent unwanted inserts such as mosquitos or moths from passing through the opening.

It is also to be understood that in the context of this specification, retrofitting refers to the fitting or installation of the screen system into an existing or separate window or door frame which for the sake of convenience we will refer collectively as the frame. This may occur during construction of a building as the frames will be installed first, and then embodiments of the screen system described herein are subsequently fitted to some or all of the frames during the construction phase. This may be immediately after installation of the window frames, for example by the same installer, or at a later time such as days or weeks later, by the same or a different installer. Similarly the system could be installed into existing doors or windows in a building during occupancy, ie years after construction. As will become apparent the screen system is designed to be independent of the window frame, so that it can be installed and maintained separately or independently from the window, and if needed removed independently of the window. That is embodiments of the system described herein are not integral in a frame or built into a frame, but rather the system is designed to be attached (or attachable) to an existing frame. Embodiments of the system may be retrofitted such that they appear seamless or integrated with the frame, when in fact they are separately removable.

Additionally, the system could also be used for windows with multiple sliding panels. For example in one embodiment the window is comprised of 4 panels in which the inner 2 slide away from each other to cover each of the outer two panels to define a central opening corresponding to the original location of the inner two windows. In this case, the screen support assembly does not span the full width of the four windows, and instead only needs to be wide enough to span the inner two windows (ie the central opening). When installed, the edges of the screen support assembly are aligned with the inner edges of the first and fourth window panels (ie the boundaries of the first and second panels, and the third and fourth panels, when closed).

The above embodiment provides an effective and low profile retrofitable system for providing a retractable screen. However, other variations and embodiments are possible. For example, in other embodiments, the pulleys used as guide components could be replaced with other equivalent components which can guide the cord or operative means without substantial resistance, such as a low friction plastic block formed with a guide channel. In another variation, the locations of the second pulley and the tension adjustment arrangement could be switched. In this case, a double back path is still provided, but the spring 243 of the tension adjustment arrangement would be located distal of the third pulley 239. Further, more complicated arrangements utilising multiple tensioners and multiple double backs could be used, although these are less desirable as they increase the size and profile of the screen support assembly.

Figure 5:
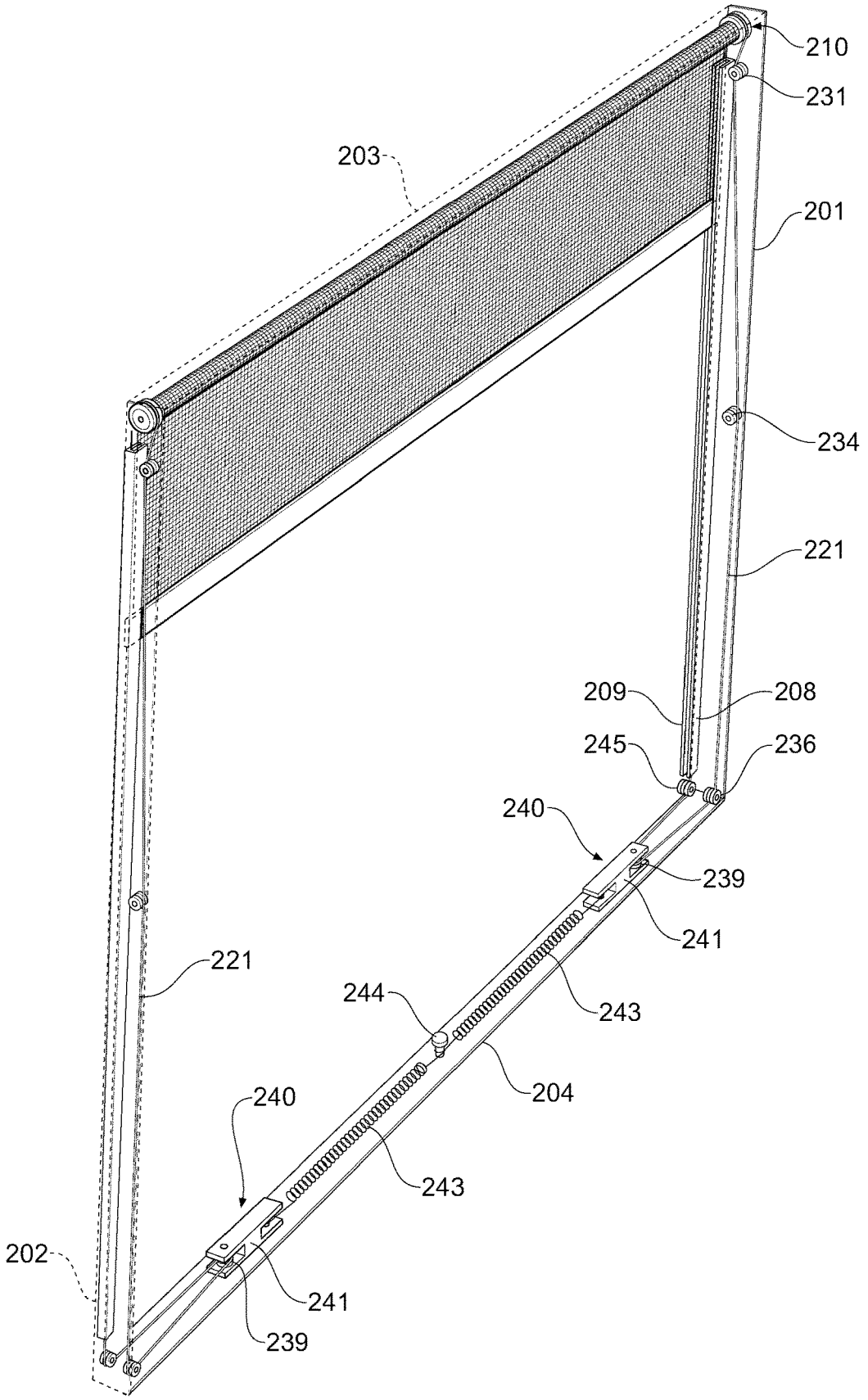
FIG. 5 illustrates a window frame with a tension adjustment arrangement located on a lower frame member according to an embodiment.

In another embodiment, the location of the components could be distributed over the side and lower frame members. FIG. 5 illustrates a window frame with a tension adjustment arrangement located on a lower frame member according to an embodiment. In this embodiment, the second pulley 236 is located at the inner edge of the corner of the first side frame member and the lower frame member 204 to direct the cord through or around the corner so that it follows the lower frame member 204 (ie the axis of rotation is directed into the window). Alternatively, a solid piece with a 90° channel could be used. The third pulley 239 is located on the lower frame member with a vertical axis of rotation so as to redirect the cord back to the corner (ie provide a double back path). In the outer edge of the corner of the first side frame member and the lower frame member 204 is the fourth pulley 246 orientated like second pulley 236 with an axis of rotation directed into the window, The fourth pulley guide the cord 221 into the first screen guide channel 206 (by passing around the fourth pulley 245) where it is anchored to anchor point 222 of the distal edge.

In this embodiment, the tension adjustment arrangement is located along the lower frame member 204. As previously described the tension adjustment arrangement comprises a pulley housing 241 that houses the third pulley 239 at the distal end, and a first spring anchor 242 at the proximal end, to which the distal end of a spring 243 is fixed. An identical arrangement could be provided for the second side frame member. In this embodiment the spring anchor can be located at the mid-point of the lower frame member, and act as a common anchor point for the springs for both tension adjustment arrangements. This embodiment could be utilised where, unlike the embodiment shown in FIG. 1C, there is no winding mechanism, or where any window opening or locking mechanism is in a central location on the lower frame member 204 or in cases where the mechanism will not interfere with the tension adjustment arrangement.

Figure 6A:
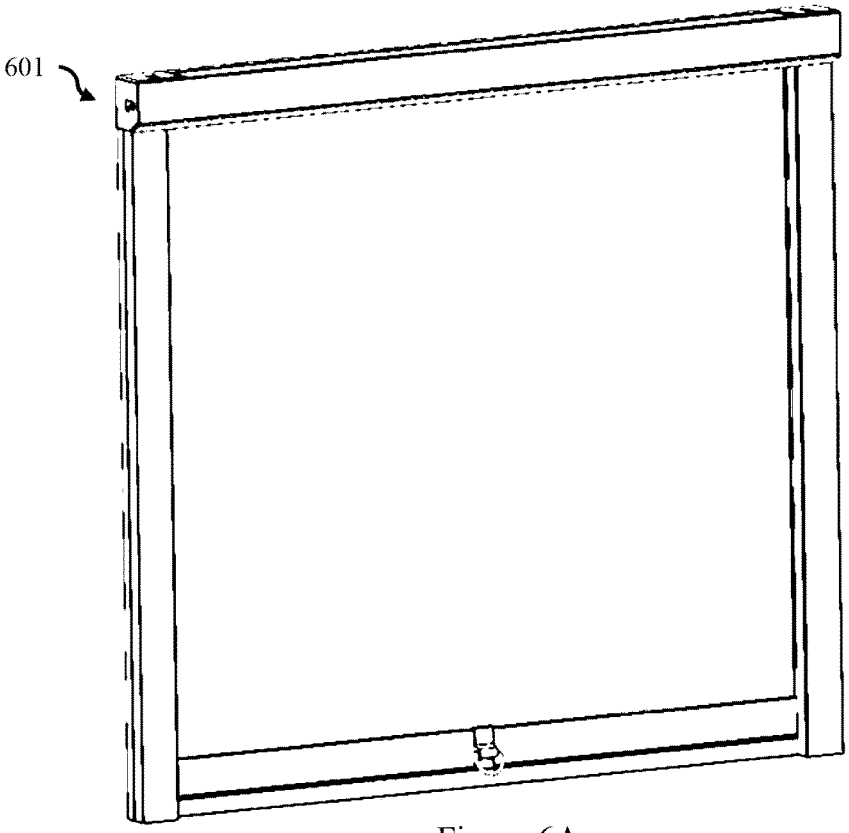
FIG. 6A is a perspective view of a retrofitable screen system according to an embodiment.
Figure 6B:
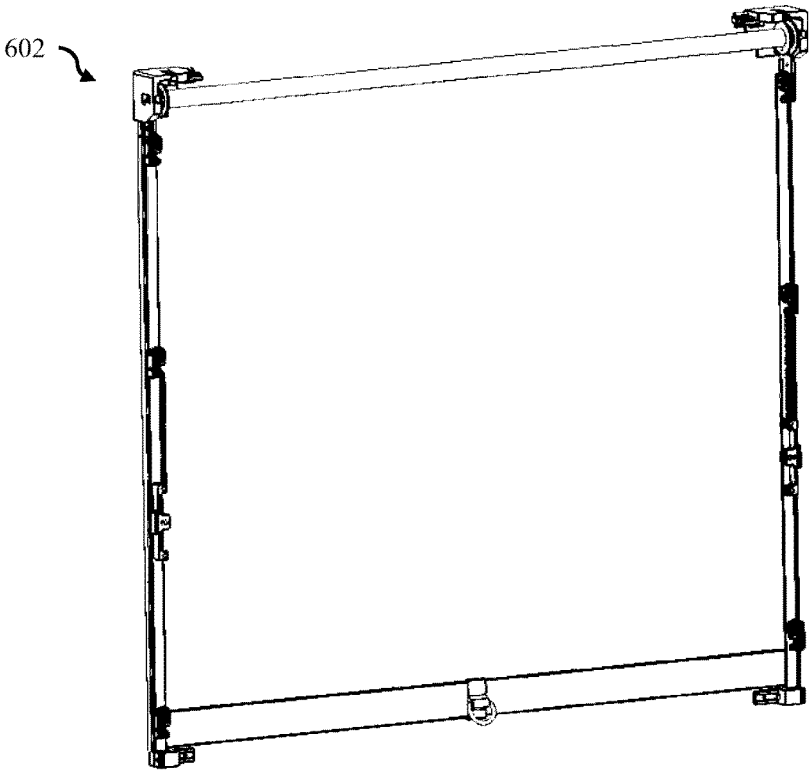
FIG. 6B is a perspective view of the retrofitable screen system of FIG. 6A with exterior cover members removed to show internal components.
Figure 12A:
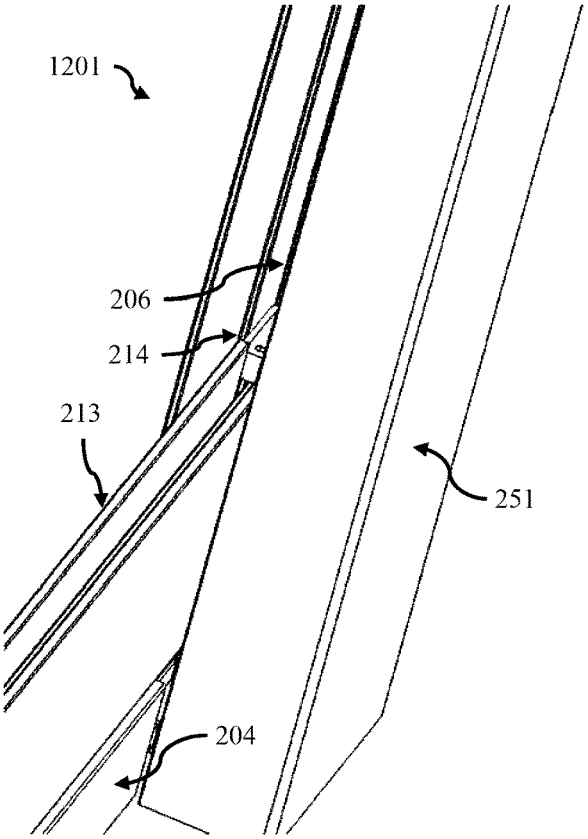
FIG. 12A is a first perspective view of the lower right corner of the of the retrofitable screen system of FIG. 6B with covers in place according to an embodiment.
Figure 12B:
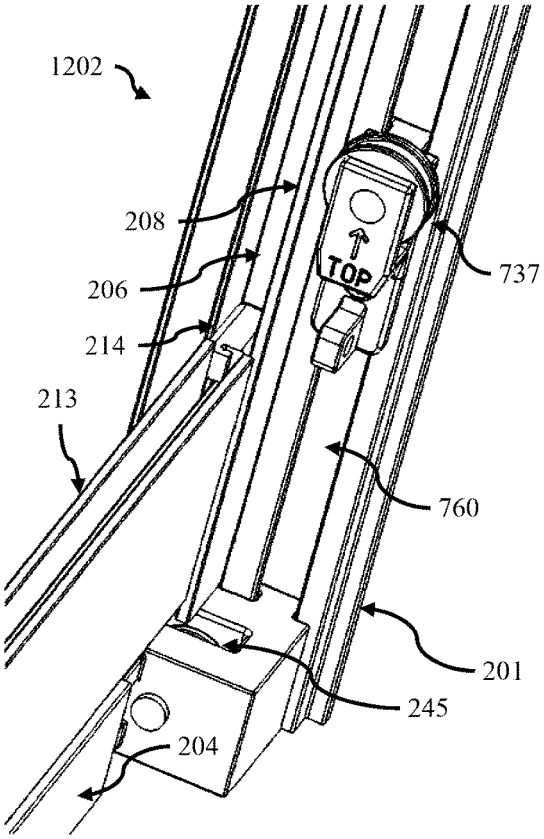
FIG. 12B is a second perspective view of the perspective view of FIG. 12A with covers removed according to an embodiment.
Figure 12C:
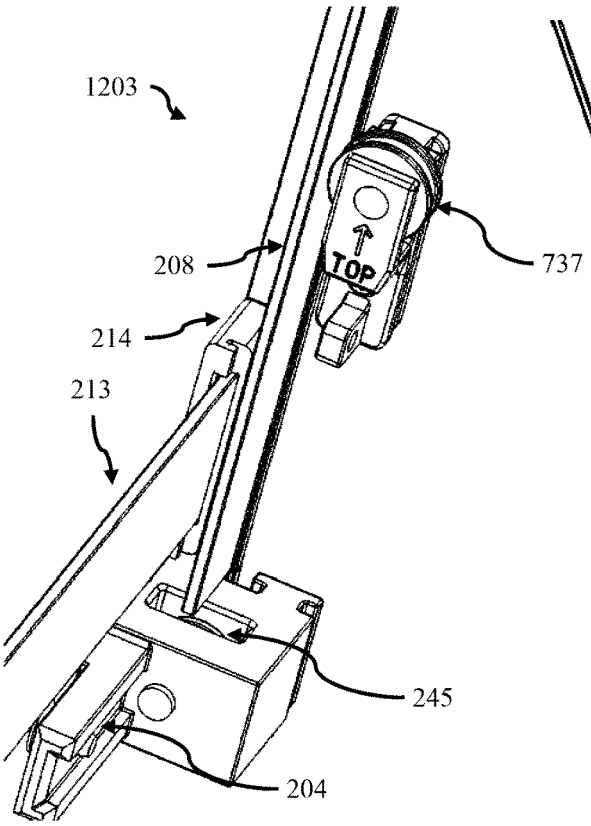
FIG. 12C is a third perspective view of the perspective view of FIG. 12A with covers and outer frame members removed according to an embodiment.
Figure 12D:
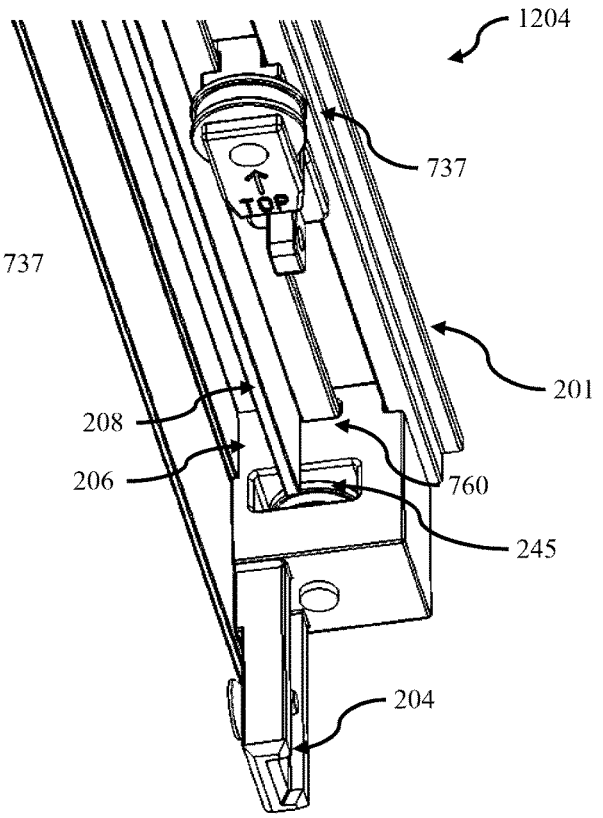
FIG. 12D is a fourth perspective view of the lower right corner of the of the retrofitable screen system of FIG. 6B with covers removed according to an embodiment.

FIG. 6A through to FIG. 12D illustrate various views of another embodiment of a retrofitable screen system. FIG. 6A is a perspective view 601 of a retrofitable screen system according to an embodiment and FIG. 6B is a perspective view 602 of the retrofitable screen system of FIG. 6A with exterior cover members removed to show internal components.

Figure 7A:
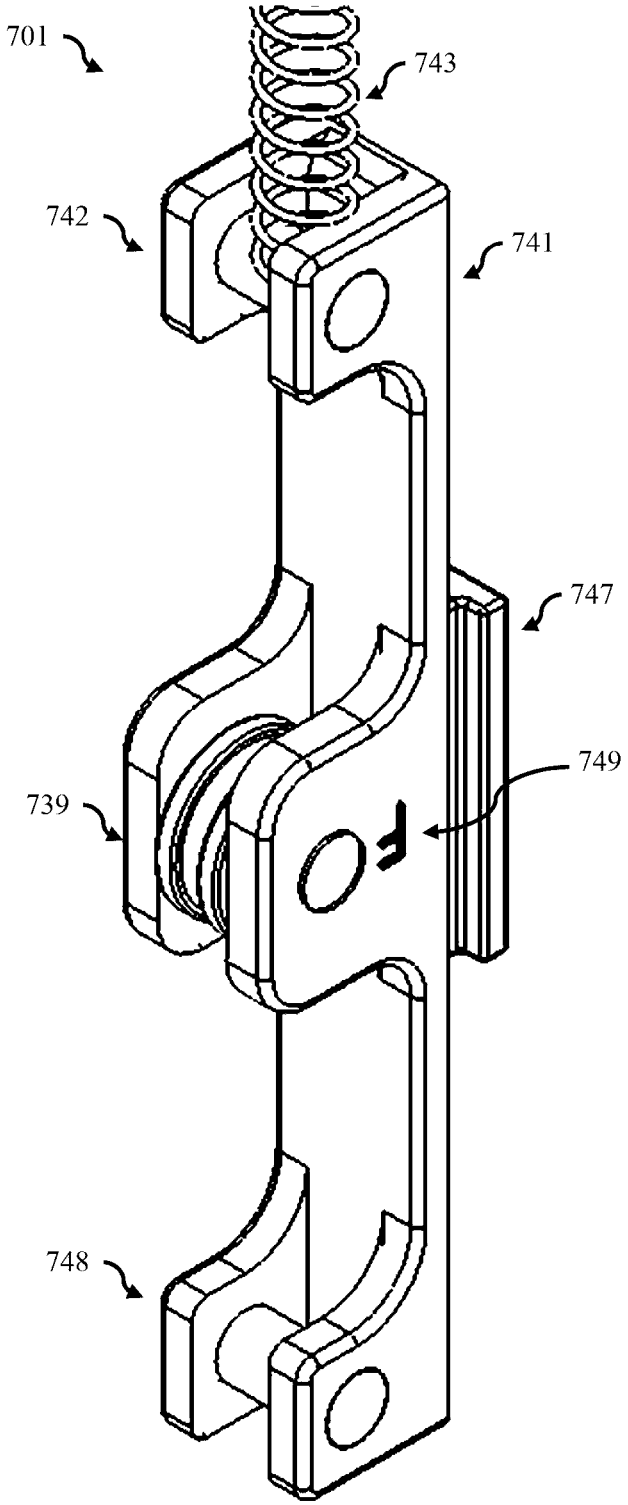
FIG. 7A is a front perspective view of a tension adjustment arrangement according to an embodiment.
Figure 7B:
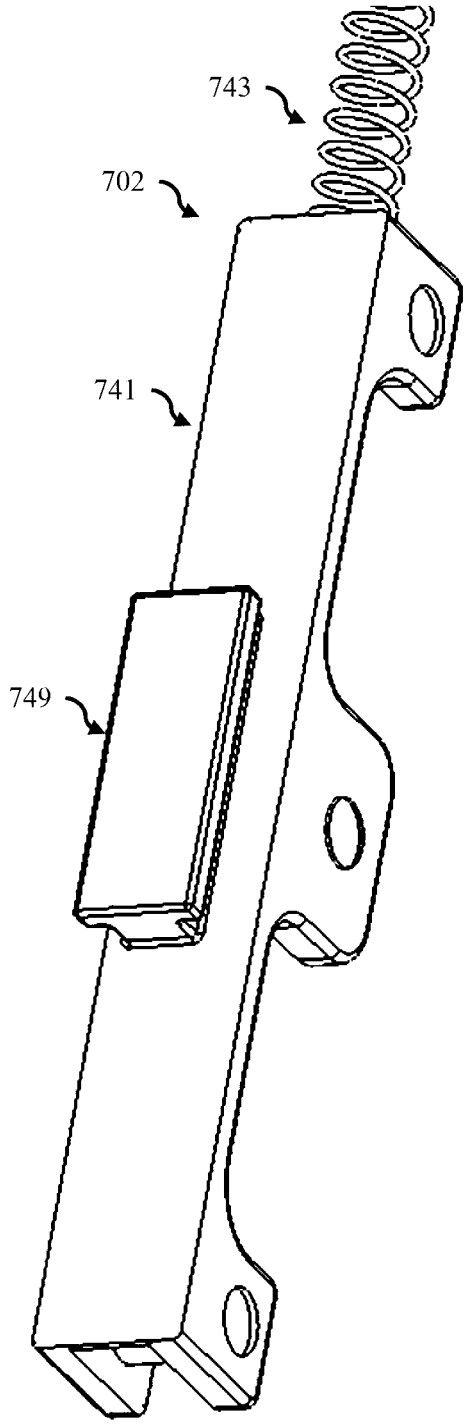
FIG. 7B is a rear perspective view of the tension adjustment arrangement of FIG. 7A.
Figure 7C:
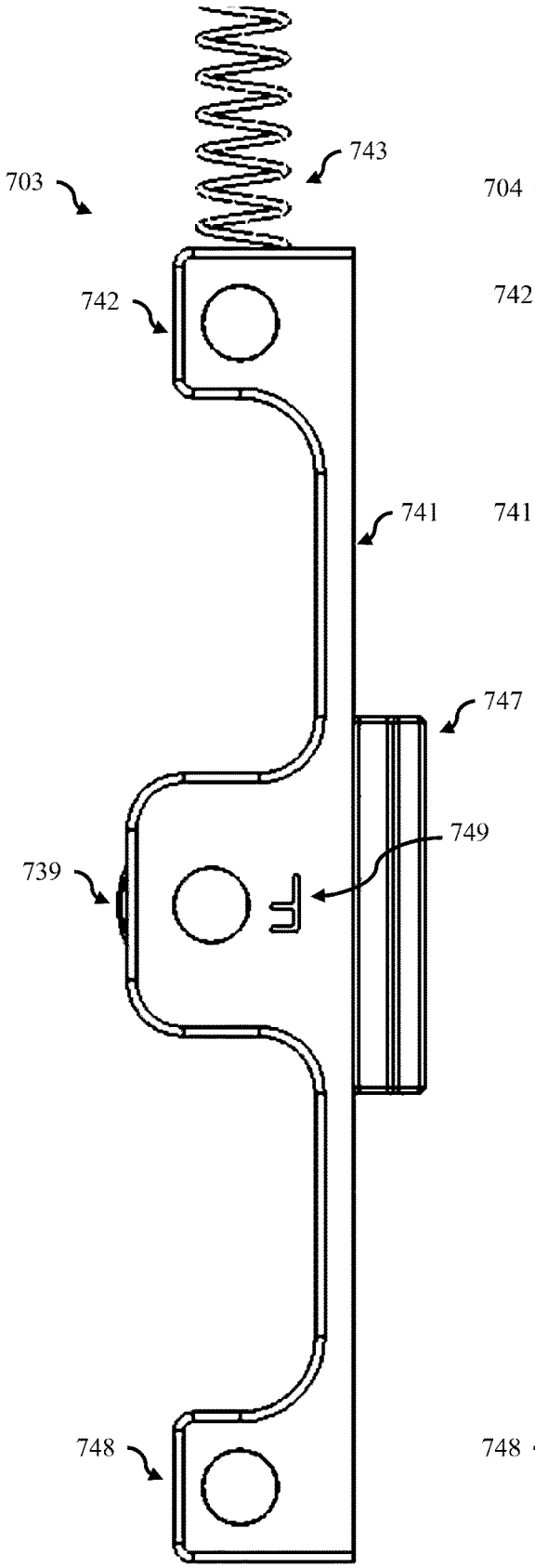
FIG. 7C is a side view of the tension adjustment arrangement of FIG. 7A
Figure 7D:
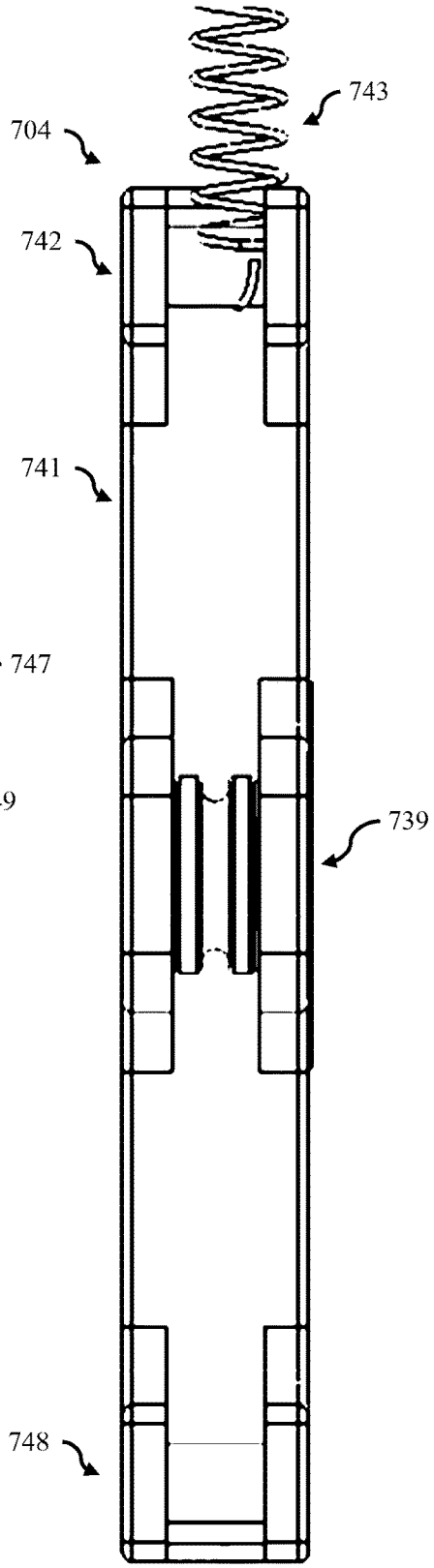
FIG. 7D is a top view of the tension adjustment arrangement of FIG. 7A

In this embodiment the tension adjustment arrangement 240 comprises a body 741 which supports a central pulley 739 with two spring anchors 742 748 on either end of the body 741. A support 747 is formed or connected to the base of the body 741, and is formed with a T shaped profile to allow location within a channel 760 formed on the side support member. FIG. 7A is a front perspective view 701 of the tension adjustment arrangement, FIG. 7B is a rear perspective view 702 of the tension adjustment arrangement, FIG. 7C is a side view 703 of the tension adjustment and FIG. 7D is a top view 704 of the tension adjustment arrangement of FIG. 7A. The tension adjustment arrangement is symmetrically designed enabling the same unit to be used on either side frame of the of the retrofitable screen system, thus reducing the number of parts to be constructed. To facilitate installation a marker "F" 749 is printed on the front facing side of the body 741. In this embodiment where the tension adjustment arrangement is located on the right hand side the spring 743 is attached to the first spring anchor 742, and when the tension adjustment arrangement is located on the left hand side, the spring 743 is attached to the second spring anchor 748.

Figure 8A:
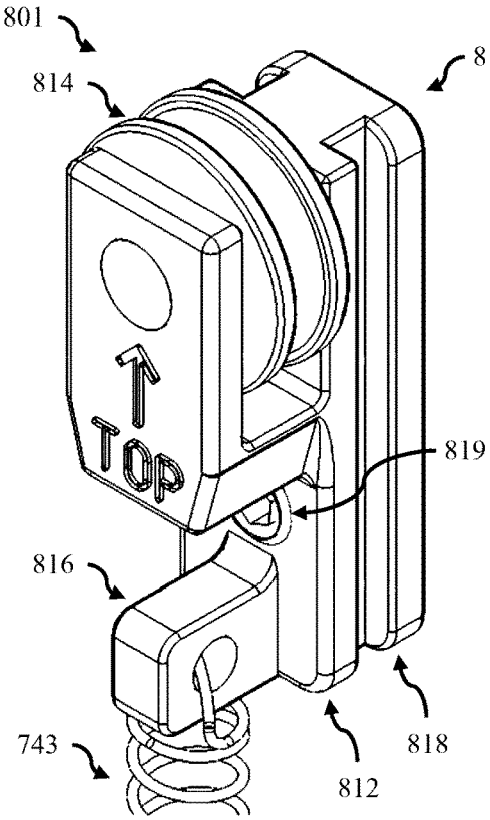
FIG. 8A is a perspective view of a pulley mount arrangement according to an embodiment.
Figure 8B:
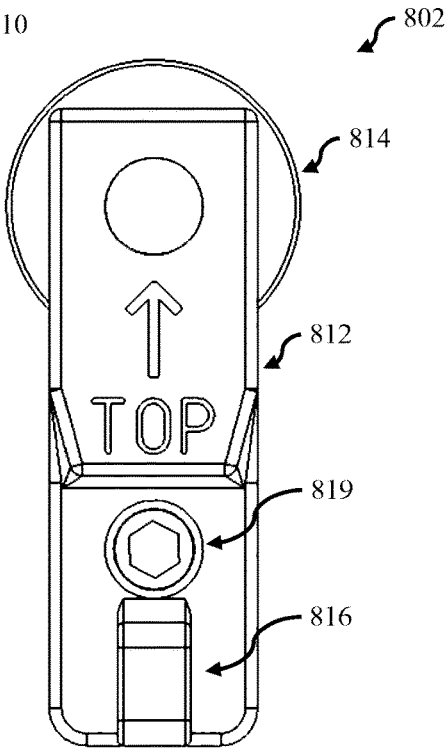
FIG. 8B is a front view of the pulley mount adjustment arrangement of FIG. 8A.
Figure 8C:
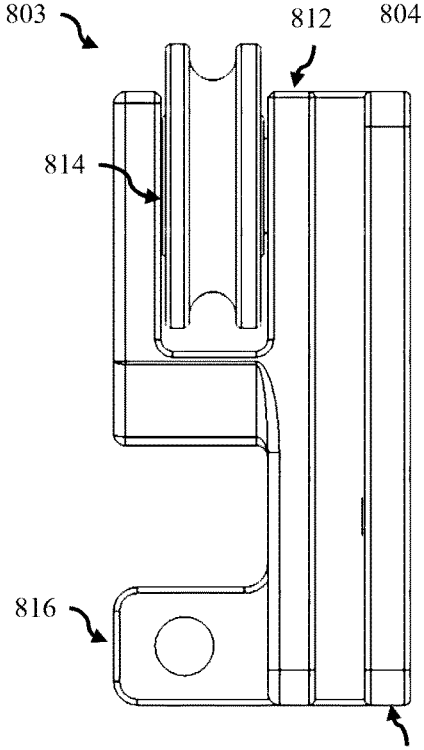
FIG. 8C is a first side view of the pulley mount arrangement of FIG. 8A
Figure 8D:
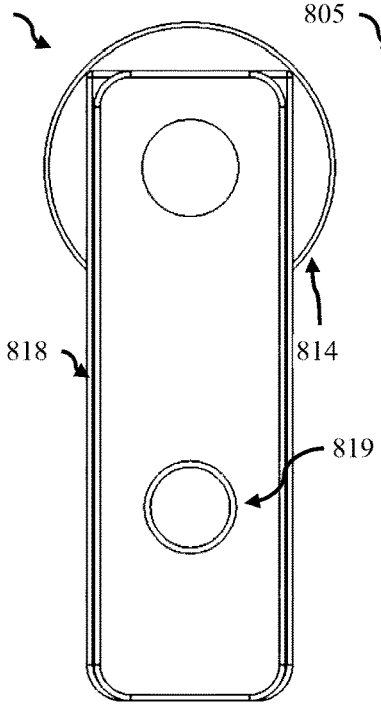
FIG. 8D is a rear view of the pulley mount arrangement of FIG. 8A
Figure 8E:
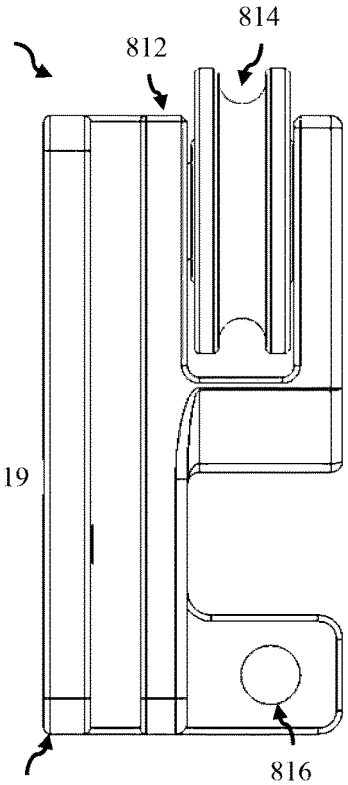
FIG. 8E is a second side view of the pulley mount arrangement of FIG. 8A

Further, in this embodiment the first guide projection 731, the second guide projection 734, the second spring anchor 744, and the second pulley fixed mount 237 all use the same design of a pulley mount arrangement 810. FIG. 8A is a perspective view 801 of this embodiment of the pulley mount arrangement 810, FIG. 8B is a front view 802 of the pulley mount arrangement. FIG. 8C is a first side view 803 of the pulley mount arrangement, FIG. 8D is a rear view 804 of the pulley mount arrangement and FIG. 8E is a second side view 805 of the pulley mount arrangement. This pulley mount arrangement comprises a body 812 which supports a pulley 814 at one end of the body and a spring anchor 816 at the other end of the body. A support 818 is formed or connected to the base of the body 812, and is formed with a T shaped profile, similar to that of support 747 of the tension adjustment arrangement to allow location within a channel, such as that formed on the side support member. A fixing means 819 such as a rotatable screw arrangement which can pass through the body 812 and support 818 is also provided to allow the pulley mount arrangement to be fixed in a particular location. This facilitates manufacturing as the same design can be reused for different components.

Figure 9A:
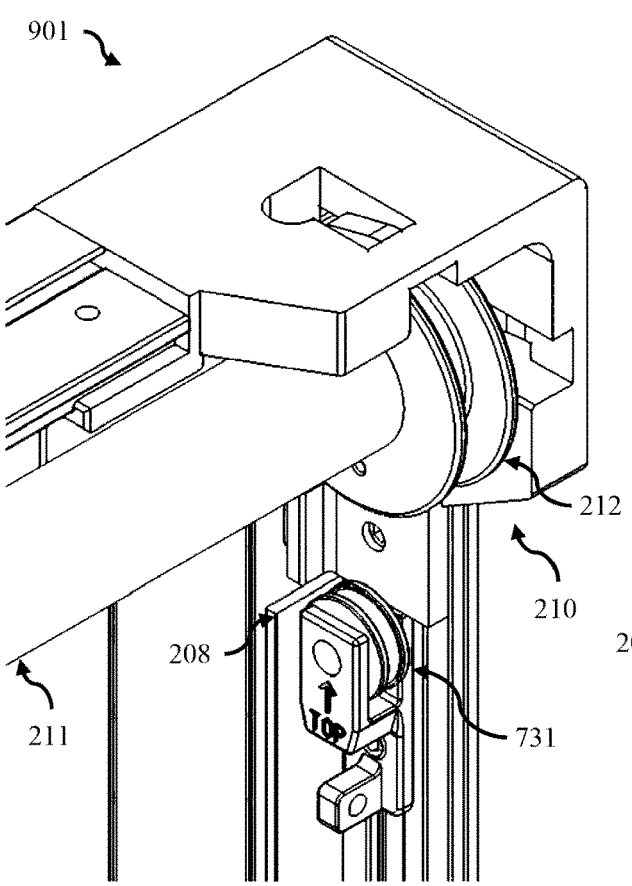
FIG. 9A is a first perspective view of upper right corner of the retrofitable screen system of FIG. 6B illustrating the roller assembly, inner wall and first guide projection according to an embodiment.
Figure 9B:
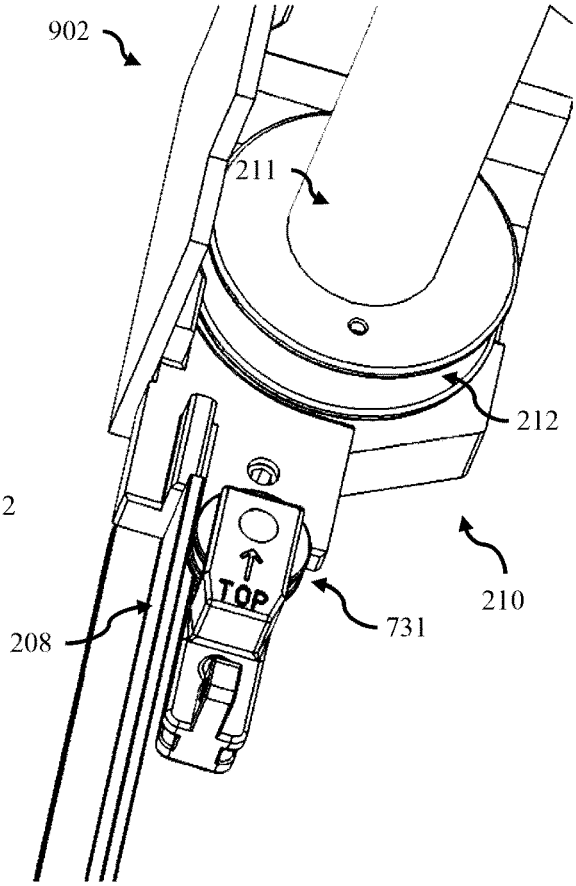
FIG. 9B is a second perspective view of the upper right corner of the retrofitable screen system of FIG. 6B illustrating the roller assembly, inner wall and first guide projection according to an embodiment.
Figure 9C:
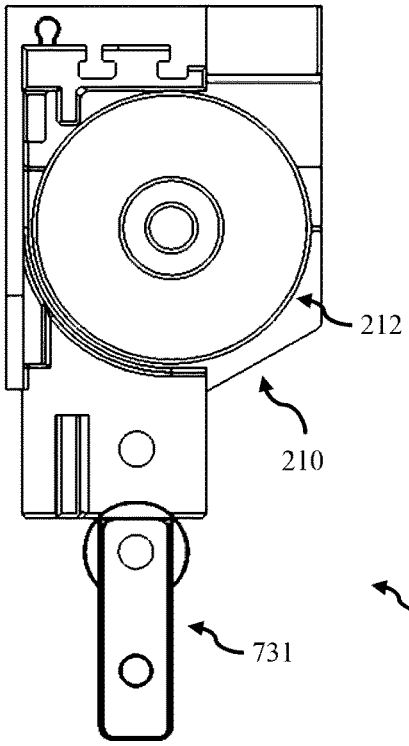
FIG. 9C is a first side view of upper right corner of the retrofitable screen system of FIG. 6B illustrating the roller assembly, inner wall and first guide projection according to an embodiment.
Figure 9D:
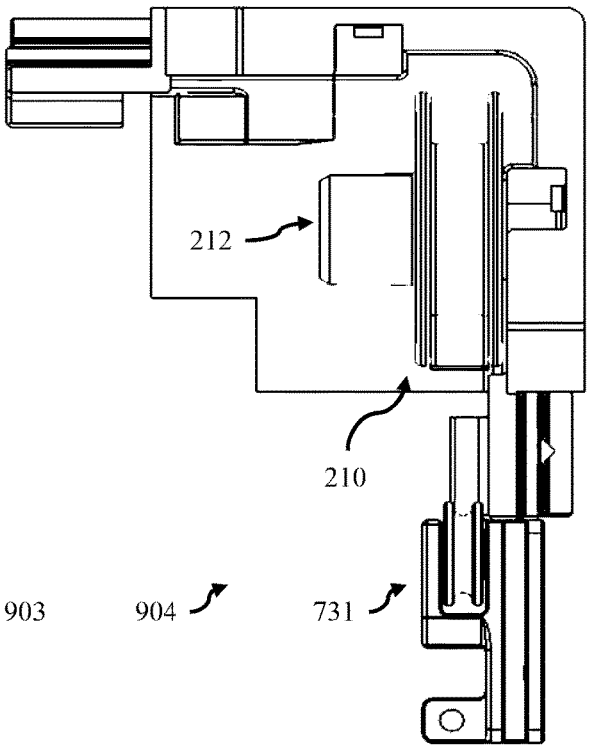
FIG. 9D is a front view of the upper right corner of the retrofitable screen system of FIG. 6B illustrating the roller assembly, inner wall and first guide projection according to an embodiment.

This is further illustrated in FIGS. 9A to 12D. FIG. 9A is a first perspective view 901 of upper right corner of the retrofitable screen system of FIG. 6B illustrating the roller assembly, inner wall and first guide projection according to an embodiment. FIG. 9B is a second perspective view 902, FIG. 9C is a first side view 903 and FIG. 9D is a front view 904 of the upper right corner of the retrofitable screen system of FIG. 6B illustrating the roller assembly 210 (including screen 211 and spindle 212), inner wall 208 and first guide projection 731, which in this embodiment is the pulley mount arrangement 810 of FIGS. 8A to 8E.

Figure 10A:
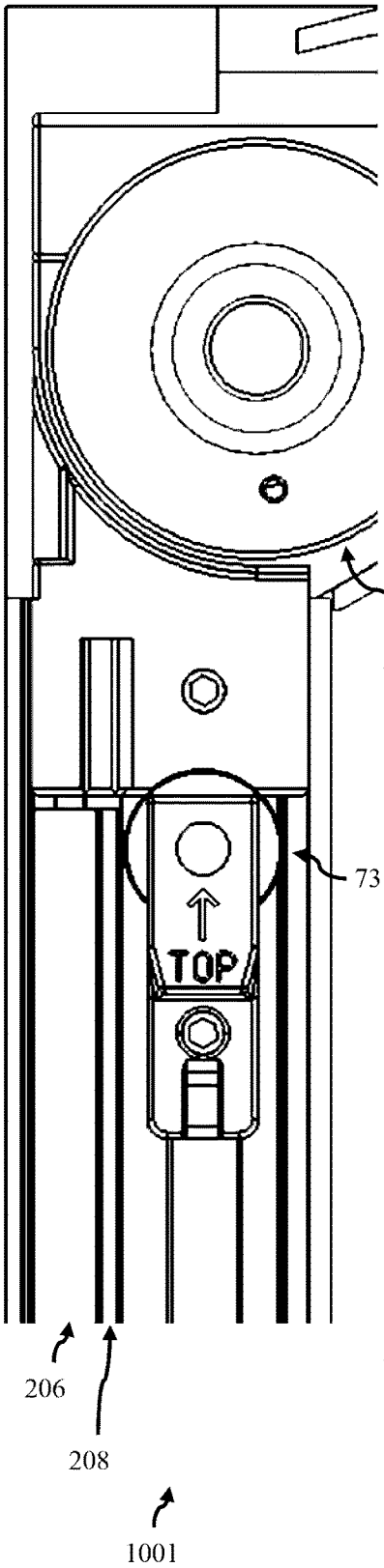
FIG. 10A is a side view of the upper right portion of the retrofitable screen system of FIG. 6B illustrating the roller assembly, inner wall and first guide projection according to an embodiment.
Figure 10B:
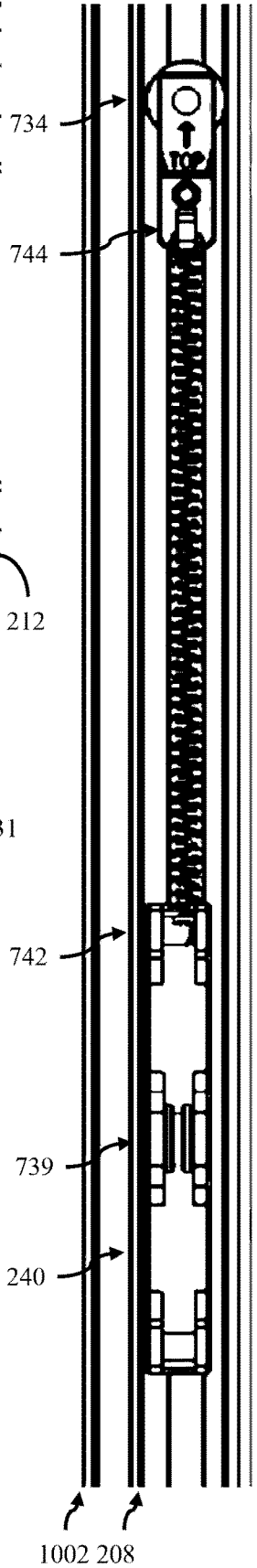
FIG. 10B is a side view of the middle right portion of the retrofitable screen system of FIG. 6B illustrating the second guide projection, the spring and the tension adjustment arrangement according to an embodiment.
Figure 10C:
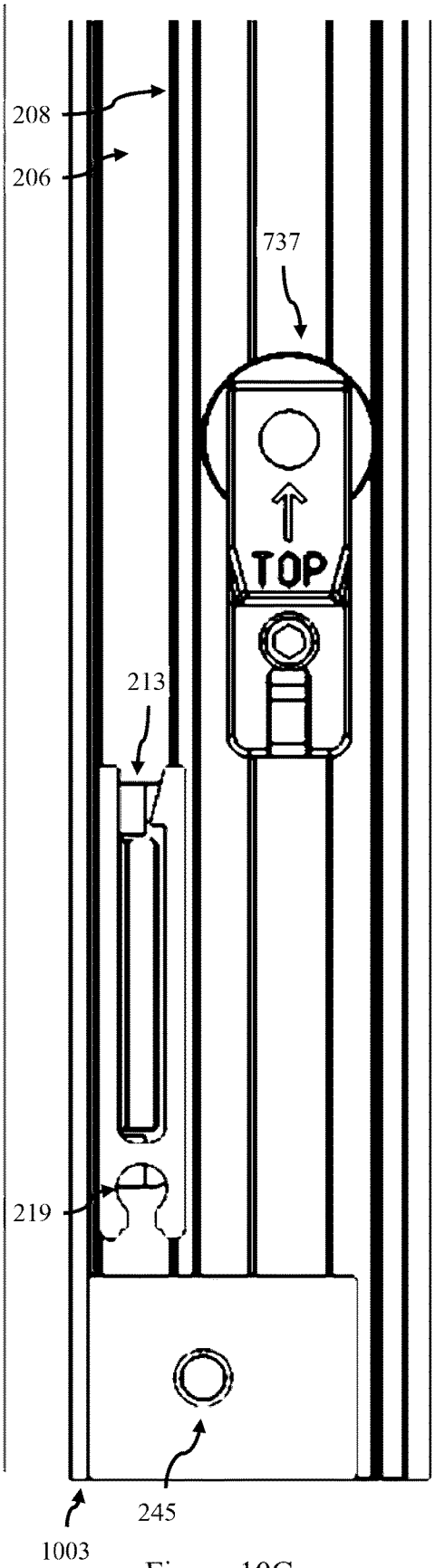
FIG. 10C is a side view of the lower right portion of the retrofitable screen system of FIG. 6B illustrating the second pulley mount, fourth pulley, inner wall and first edge of the screen according to an embodiment.

FIG. 10A is a first side view 1001 of the upper right portion, FIG. 10B is a second side view 1002 of the middle right portion and FIG. 10C is a third side view 1003 of the lower right portion of the retrofitable screen system of FIG. 6B illustrating the first guide projection 731, second guide projection 734, second spring anchor 744, tension adjustment arrangement 240, second pulley mount 737, fourth pulley 245, inner wall 208 and first edge 213 of the screen according to an embodiment. FIG. 10C additionally shows the clipping profile 219 of the first edge 213.

Figure 11A:
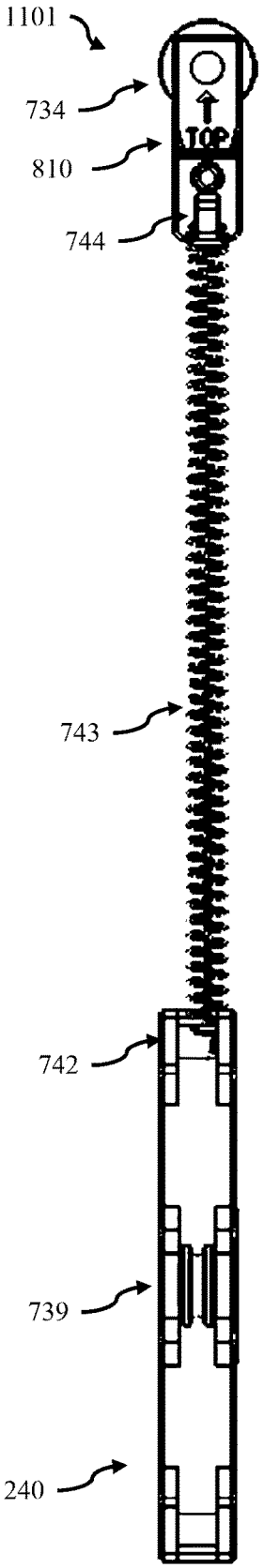
FIG. 11A is a side view of the second guide projection, the spring and the tension adjustment arrangement according to an embodiment.
Figure 11B:
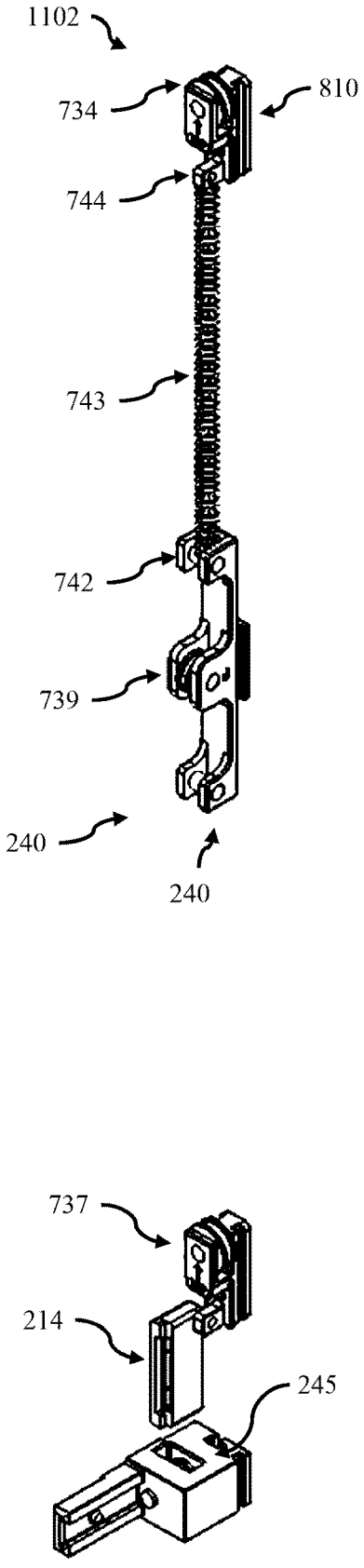
FIG. 11B is a first perspective view of the second guide projection, the spring and the tension adjustment in relation to the second pulley mount, fourth pulley, inner wall and first edge of the screen according to an embodiment.
Figure 11C:
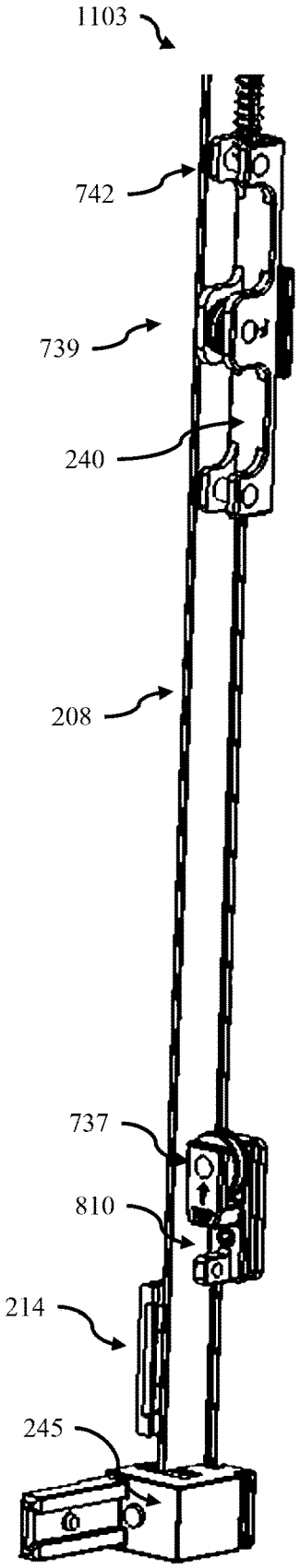
FIG. 11C is a second perspective view of the second guide projection, the spring and the tension adjustment in relation to the second pulley mount, fourth pulley, inner wall and first edge of the screen, further showing the inner wall according to an embodiment.

FIG. 11A is a side view 1101 of the second guide projection 734, the spring 743 and the tension adjustment arrangement 240 according to an embodiment. FIG. 11B is a first perspective view 1102 of the second guide projection 734, the spring 743 and the tension adjustment 240 in relation to the second pulley mount 737, fourth pulley 245, inner wall 208 and first edge 213 of the screen according to an embodiment. FIG. 11C is a second perspective view 1103, further showing the inner wall 208 according to an embodiment.

FIG. 12A is a first perspective view 1201 of the lower right corner of the of the retrofitable screen system of FIG. 6B with first side member cover 251 in place according to an embodiment. FIG. 12B is a second perspective view 1202 of the perspective view of FIG. 12A with first side cover 251 removed, FIG. 12C is a third perspective view 1203 of the perspective view of FIG. 12A with first side cover 251 and outer frame members removed and FIG. 12D is a fourth perspective view 1204 of the lower right corner of the of the retrofitable screen system of FIG. 6B with first side cover 251 removed according to an embodiment. These views illustrate the second pulley mount 737, fourth pulley 245, first screen guide channel 206, inner wall 208, first edge 213 of the screen, and first end 214 of the first edge of the screen. Additionally the channel 760 within which the T shaped supports 747 818 of the tension adjustment arrangement 240 and pulley arrangement 810, respectively, are located are illustrated in FIGS. 12B and 12D. FIGS. 9A to 12D further illustrate the extrusions which form the side members of the screen support assembly 200 to which covers 250 are mounted.

In another embodiment, two systems could be retrofitted or installed in the same frame. The first system could be an insect screen system comprising a mesh screen immediately adjacent or proximal to the window, and the second system could be a semi-opaque screen system with installed distal of the window and first system. Alternatively the second screen system could be a blockout (fully opaque) system. In another embodiment the first system could be a semi-opaque screen system and the second system could be a block out system. In another embodiment three systems can be retrofitted or installed in the same frame—ie the first system has an insect screen, the second system has a semi-opaque screen and the third system has a fully opaque screen. In one embodiment all three systems are located within the frame—ie first system proximal to the window, third system most distal and the second system located between the two. Embodiments of the system could also be retrofitted to window frames with permanent insect screens—for example to add a semi-opaque and/or block screen to the window.

In one embodiment the system, or one system in the case when there are multiple systems, is fitted to the interior facing surface of the frame rather than fitted within the frame. In the multiscreen embodiments described above, an insect mesh or semi-opaque system may be installed within the frame, and a blockout system may be installed to the interior face of the frame so that the full opening is blocked out. In one embodiment in which the window is a sliding (vertically or laterally) window, a system could be fitted to the exterior surface of the frame. This would then be adjustable from either outside of the building, or when the window is open.

Embodiments of the system can be retrofitted to a door or window to replace a screen door or permanent insect screen. In this embodiment the screen door or permanent insect system can be removed, and an insect screen system could then be attached to the existing door or window frame. This allows selective use of the insect screen, for example only when the door or window is open. In use the screen can be retracted to allow a person to pass through the door, and can also be retracted on demand when greater airflow is desired, for example to more rapidly vent the building, or at times of the year when insects are not of concern. This would allow you to pull the screen down when required and in normal use the screen would be retracted, and so when passing through only one door rather than two needs to be opened to pass through. When the screen is no longer required the screen is retracted and all that is left is an empty frame in the track In one embodiment, an extension piece can be attached to the bottom of the distal edge 213 of the screen in cases where the screen distal frame member 204 is omitted (ie the screen support assembly comprises three frame members 201 202 203) or in cases where the distal edge does not fully contact the lowest surface of the frame, or where full blockout is not achieved when the screen is extended. In one embodiment, this extension piece comprises a screen attachment means 219 along a first edge to attach the extension piece to the distal edge of the screen 213, and deformable edge (distal of the first edge) comprised of brushes or a soft plastic to allow complete blockout to be achieved when the screen is fully extended within the frame. In one embodiment the screen attachment means comprises a clipping formation in the first edge. For example the cross sectional profile of the first edge may be is shaped as clip, eg with a clockwise rotated C shaped profile with extending resilient arms (see screen attachment means 219 in FIG. 10C). In another embodiment the first edge is fitted with a plurality of clips, studs, magnets or other releasable arrangements to allow releasable attachment to the distal edge of the screen.

The system described herein provides an improved retrofitable arrangement to provide a retractable screen for a moving panel. When the window panel is closed, the screen can be fully retracted so that is does not obstruct the view to any extent. Further the system can be easily retrofitted to a range of existing windows without screens. One advantage of the screen system is that is does not require any form of spring based tensioning arrangements to rewind the screen onto the roller assembly. Instead, the arrangement guides an operative member through a double back path through or around a tension adjustment arrangement to provide a smooth mechanism to extend and retract the screen. When the screen is extended, pushing the distal edge to force retraction of the screen is translated into a pulling action on the cord to unwind the cord off the first pulley, and this drives the rotation of the spindle to wind the screen back on. Conversely, pulling the distal edge to extend the screen rotates the spindle and pulley to wind the cord back onto the first pulley. This guide assembly is relatively compact, allowing the support assembly to have a low thickness/profile so that the support assembly does not extend in from the window frame and unnecessarily obscure the window panel. Further, to improve the smoothness and to provide adjustability, the guide assembly can include a tension adjustment assembly.

Throughout the specification and the claims that follow, unless the context requires otherwise, the words "comprise" and "include" and variations such as "comprising" and "including" will be understood to imply the inclusion of a stated integer or group of integers, but not the exclusion of any other integer or group of integers.

The reference to any prior art in this specification is not, and should not be taken as, an acknowledgement of any form of suggestion that such prior art forms part of the common general knowledge.

It will be appreciated by those skilled in the art that the disclosure is not restricted in its use to the particular application described. Neither is the present disclosure restricted in its preferred embodiment with regard to the particular elements and/or features described or depicted herein. It will be appreciated that the disclosure is not limited to the embodiment or embodiments disclosed, but is capable of numerous rearrangements, modifications and substitutions without departing from the scope of the disclosure as set forth and defined by the following claims.

What is claimed is:

1. A retrofitable retractable screen system for insertion into a frame of a window or door opening to allow the window or door opening to be covered when in an open position, the system comprising:

a screen support assembly defining a screen opening and adapted for insertion into and removal from a window or a door frame;

a roller assembly comprising:

a screen;

a spindle rotatably mounted adjacent the screen opening around which the screen is wound so that the screen can be unwound from or wound onto the spindle; and a spindle rotation assembly for rotating the spindle;

at least one operative means connected between the screen and the spindle rotation assembly that causes the spindle to rotate so as to wind the screen back onto the spindle as the screen is retracted across the screen opening; and at least one guide assembly for guiding the operative means, wherein the guide assembly includes first and second guide components which guides the operative means through or around a tension adjustment arrangement that adjusts the tension in the operative means as the screen is wound and unwound from the spindle, wherein the operative means is guided from the spindle rotation assembly to the first guide component which directs the operative means to the tension adjustment arrangement, and the tension adjustment arrangement directs the operative means to the second guide component which directs the operative means to a distal edge of the screen with respect to the spindle, wherein the screen support assembly comprises at least one side frame member with an internal channel defined by an inner wall extending orthogonally from a side wall and in inward spaced relationship from a first edge of the sidewall and a rear wall located at a second edge of the side wall and extending orthogonally from the side wall, for guiding a portion of the distal edge of the screen as it is unwound from and wound onto the spindle, and the second guide component directs the operative means to extend along and within the at least one internal channel where it is anchored to the portion of the distal edge of the screen located in the at least one internal channel, and the tension adjustment arrangement is located proximal, with respect to the spindle, of both the first guide component and the second guide component and adjacent the inner wall and the side wall and is located on a side of the inner wall opposite the rear wall, to direct the operative means through a double back path via the tension adjustment arrangement, and the first guide component and the second guide component are pulleys each with an axis parallel to a spindle axis, and the tension adjustment arrangement comprises a spring anchored to the screen support assembly at a proximal end, and to a pulley housing at the distal end, and the distal end of the pulley housing houses a pulley with an axis orthogonal to the spindle axis.

2. The retrofitable retractable screen system as claimed in claim 1, wherein the spindle rotation assembly comprises a spindle pulley and the at least one operative means is a cord that wraps around the spindle pulley, such that as the screen is wound onto the spindle as the screen is retracted across the screen opening, the cord is wound off the spindle pulley.

3. The retrofitable retractable screen system as claimed in claim 1, wherein the screen support assembly is a frame arrangement comprising a spindle frame member, a first side frame member, a second side frame member, and a distal frame member, wherein the at least one guide assembly is housed in one or both of the first side frame member and the second side frame member.

4. The retrofitable retractable screen system as claimed in claim 3, wherein the at least one operative means comprises two operative means, and the at least one guide assembly comprises two guide assemblies and each of the first side frame member and the second side frame member house an operative means and a guide assembly.

5. The retrofitable retractable screen system as claimed in claim 3, wherein the one or both first side frame member and the second side member that house the at least one guide assembly comprise a removable cover for providing access to the at least one guide assembly.

6. The retrofitable retractable screen system as claimed in claim 1, wherein the screen comprises a distal edge, the distal edge comprising a handle to allow independent extension and retraction of the screen independent of movement of the window panel.

7. The retrofitable retractable screen system as claimed in claim 1, wherein the screen comprises a distal edge, the distal edge comprising a window panel attachment means, for attachment to a handle of the window panel such that movement of the window panel to open and close the window causes extension and retraction of the screen across the window opening.

8. The retrofitable retractable screen system as claimed in claim 4, wherein the one or both first side frame member and the second side member that house the at least one guide assembly comprise a removable cover for providing access to the at least one guide assembly.

9. A retrofitable retractable screen system for insertion into a frame of a window or door opening to allow the window or door opening to be covered when in an open position, the system comprising:

a screen support assembly defining a screen opening and adapted for insertion into and removal from a window or a door frame;

a roller assembly comprising:

a screen;

a spindle around which the screen is wound and rotatably mounted adjacent the screen opening so that the screen can be unwound from or wound onto the spindle;

a spindle mounting assembly to rotatably mount the spindle;

a linkage connected between the screen and the spindle mounting assembly that causes the spindle to rotate so as to wind the screen back onto the spindle as the screen is retracted across the screen opening; and at least one guide assembly for guiding the linkage, wherein the guide assembly guides the linkage through or around a tension adjustment arrangement that adjusts the tension in the linkage as the screen is wound and unwound from the spindle, wherein the guide assembly includes first and second guide components and the guide assembly guides the linkage from the spindle to the first guide component which directs the linkage to the tension adjustment arrangement, and the tension adjustment arrangement directs the linkage to the second guide component which directs the linkage to a distal edge of the screen with respect to the spindle, wherein the screen support assembly comprises at least one side frame member with an internal channel defined by an inner wall extending orthogonally from a side wall and in inward spaced relationship from a first edge of the side wall and a rear wall located at a second edge of the side wall and extending orthogonally from the side wall for guiding a portion of the distal edge of the screen as it is unwound from and wound onto the spindle, and the second guide component directs the linkage to extend along and within the at least one internal channel where it is anchored to the portion of the distal edge of the screen located in the at least one internal channel, and the tension adjustment arrangement is located proximal, with respect to the spindle, of both the first guide component and the second guide component and adjacent the inner wall and the side wall and is located on a side of the inner wall opposite the rear wall, to direct the linkage through a double back path via the tension adjustment arrangement, and the first guide component and the second guide component are pulleys each with an axis parallel to a spindle axis and the tension adjustment arrangement comprises a spring anchored to the screen support assembly at a proximal end, and to a pulley housing at the distal end, and the distal end of the pulley housing houses a pulley with an axis orthogonal to the spindle axis.

10. The retrofitable retractable screen system as claimed in claim 9 wherein the first guide component is distal of the inner wall with respect to the rear wall such that the axis of the first guide component is distal of the axis of the second guide component with respect to the rear wall and the second guide component is distal of the first guide component with respect to the side wall.

11. The retrofitable retractable screen system as claimed in claim 1 wherein the first guide component is distal of the inner wall with respect to the rear wall such that the axis of the first guide component is distal of the axis of the second guide component with respect to the rear wall and the second guide component is distal of the first guide component with respect to the side wall.

* * * * *